US010125512B2

(12) United States Patent
Allen et al.

(10) Patent No.: US 10,125,512 B2
(45) Date of Patent: Nov. 13, 2018

(54) GUYLESS RIG WITH OUTRIGGERS

(71) Applicant: National Oilwell Varco, L.P., Houston, TX (US)

(72) Inventors: Blaine A. Allen, Pampa, TX (US); Jay D. Furnish, Pampa, TX (US); James R. Cirone, Pampa, TX (US); Michael R. Zemanek, Pampa, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 15/281,927

(22) Filed: Sep. 30, 2016

(65) Prior Publication Data

US 2017/0335589 A1 Nov. 23, 2017

Related U.S. Application Data

(60) Provisional application No. 62/339,180, filed on May 20, 2016.

(51) Int. Cl.
*E04H 12/20* (2006.01)
*E21B 15/00* (2006.01)
*E04H 12/18* (2006.01)

(52) U.S. Cl.
CPC ..... *E04H 12/20* (2013.01); *E04H 12/187* (2013.01); *E21B 15/00* (2013.01)

(58) Field of Classification Search
CPC ..... B66C 23/42; B66C 23/78; E21B 15/00; E21B 7/023; E21B 7/02; E21B 15/006
USPC ..... 52/143; 173/186–189
See application file for complete search history.

(56) References Cited

U.S. PATENT DOCUMENTS 2,593,246 A * 4/1952 Bender ..... E21B 15/00 52/119
2,905,280 A * 9/1959 Weaver ..... B66B 9/16 52/118
2,993,570 A * 7/1961 Bender ..... E04H 12/34 52/118
3,033,527 A * 5/1962 Wilson ..... E21B 15/00 254/323
3,792,397 A * 2/1974 Reinemann ..... H01F 27/33 336/100
4,535,899 A * 8/1985 Bergeron ..... B66C 13/50 212/280
6,104,910 A * 8/2000 Koths ..... H04B 7/155 343/878
7,062,883 B1 * 6/2006 Langholz ..... E04H 12/182 52/110
7,089,705 B1 * 8/2006 Lieberman ..... E04H 12/187 248/670
9,212,524 B2 * 12/2015 Buckingham ..... E21B 15/006
(Continued)

*Primary Examiner* — Brian D Mattei
*Assistant Examiner* — Daniel J Kenny
(74) *Attorney, Agent, or Firm* — Winthrop & Weinstine, P.A.

(57) ABSTRACT

The present disclosure, in one or more embodiments, relates to a well servicing rig having a mast having a racking board, a base supporting the mast, and a stabilization system configured to secure the rig against wind loading. The stabilization system may include a pair of front outriggers, a pair of rear outriggers, a pair of racking board supports coupled to the rear outriggers, and a pair of internal guylines extending between the racking board and the racking board supports.

18 Claims, 19 Drawing Sheets

(56) References Cited

U.S. PATENT DOCUMENTS

| | | | | |
|---|---|---|---|---|
| 2011/0079568 | A1* | 4/2011 | Mau | B66C 23/78<br>212/296 |
| 2012/0265411 | A1* | 10/2012 | Deng | B66C 23/823<br>701/50 |
| 2016/0222733 | A1* | 8/2016 | Hansen | E21B 15/00 |

* cited by examiner

GUYLESS RIG WITH OUTRIGGERS

FIELD OF THE INVENTION

The present application is generally directed to oil rig assemblies. Particularly, the present application relates to stabilizing oil rig assemblies with an upright or erected mast. More particularly, the present application relates to a mobile oil rig having outriggers for stabilizing the rig against tipping from wind loading.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Land-based oil and gas drilling, servicing, and work-over rigs typically have a derrick or mast extending upward from a drill floor or base of the rig. An oil rig mast is typically assembled and/or erected at an oil well site. Once erected, some masts may extend to heights of around 100 feet or more. In some cases, the height of the mast may be substantially larger than the width or length of the drilling rig. In this way, the footprint of the oil rig may be generally small compared to the erected height of the rig, particularly where the rig is configured to be mobile. Once erected, the oil rig may be vulnerable to tipping due to wind loading along the length of the mast and/or due to jarring or other operational forces. Wind speeds can be particularly high in some oil well locations, as many oil wells are located in remote areas. Tipping can cause safety concerns for workers on the rig and can lead to damaged or destroyed equipment.

Efforts to stabilize oil rigs typically include running external guylines from a point at or near the top of the mast to anchor points on the ground. The guyline anchors are typically driven deep into the ground surface at distances of between 50 and 150 feet away from the oil rig and often in a large square or rectangular pattern around the rig. Installation of anchored guyline systems can take a substantial amount of time, adding to the time it takes to set the rig up and take the rig down. In addition, anchored external guylines typically require a larger working area at the well site, as the anchors are installed at long distances away from the rig.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a well rig having a mast, a base supporting the base, and a stabilization system configured to secure the rig against wind loading. The stabilization system may have a pair of front outriggers, a pair of rear outriggers, and a pair of internal guylines coupling the mast to the rear outriggers. In some embodiments, the stabilization system may additionally have a pair of racking board supports coupled to the rear outriggers and extending outward therefrom. The guylines may couple to the racking board supports. In some embodiments, the guylines may couple to the mast at a racking board. The mast may have a rod board in some embodiments. Moreover, the stabilization system may have a pair of bracing supports extending between the base and the racking board supports. In some embodiments, the bracing supports may be pivotably coupled to the base and to the racking board supports. The outriggers may be pivotably coupled to the base. The rear outriggers may be configured to telescope outward from the base. The racking board supports may be pivotably coupled to the rear outriggers. In some embodiments, one or more outriggers may have a food portion. The foot portion may have a jackscrew and a plurality of washers arranged proximate to the jackscrew. The foot portion may be communicably coupled to a pressure valve configured to activate in response to a force applied to the foot portion. In some embodiments, the pressure valve may be communicably coupled to an alarm configured to sound in response to activation of the pressure valve. In some embodiments, the washers may be Belleville washers. The well rig may be a mobile rig in some embodiments, and the stabilization system may be configured to be arranged in a roading position.

The present disclosure, in one or more additional embodiments, relates to a stabilization system for a well rig having a base supporting a mast. The stabilization system may have a pair of front outriggers extending from the base, a pair of rear outriggers extending from the base, and a pair of internal guylines coupling the mast to the rear outriggers. In some embodiments, the stabilization system may have a pair of racking board supports coupled to the rear outriggers an extending outward therefrom, and the guylines may couple to the racking board supports. In some embodiments, the stabilization system may have a pair of bracing supports extending between the base and the racking board supports. Moreover, one or more of the outriggers may have a foot portion having a jackscrew and a plurality of washers arranged proximate to the jackscrew. The foot portion may be communicably coupled to a pressure valve configured to activate in response to a force applied to the foot portion. The pressure valve may be communicably coupled to an alarm configured to sound in response to activation of the pressure valve.

The present disclosure, in one or more additional embodiments, relates to a method for stabilizing a well rig. The method may include extending a pair of front outriggers from a base portion of the well rig, extending a pair of rear outriggers from the base portion of the rig, extending a pair of racking board supports from the rear outriggers, and coupling a pair of internal guylines between a mast of the well rig and the racking board supports.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure, in one or more embodiments, relates to an oil rig with front outriggers, rear outriggers, and internal guylines for stabilizing the rig against wind loading and other forces. The oil rig may be a drilling, servicing, work-over, other rig, or combination thereof. The outriggers and internal guylines may stabilize the rig against wind loading and/or other forces without the need for external guylines coupled to anchors, for example. In some embodiments, the outriggers and internal guylines may allow the rig to operate in wind conditions of up to 40 or 45 miles per hour. Moreover, in some embodiments, the outriggers may include a warning or alert system to help alert workers if the rig may be in danger of tipping from wind loading, for example. The outriggers and internal guylines may further be configured to be positioned in a roading position for transporting the rig.

Figure 1:
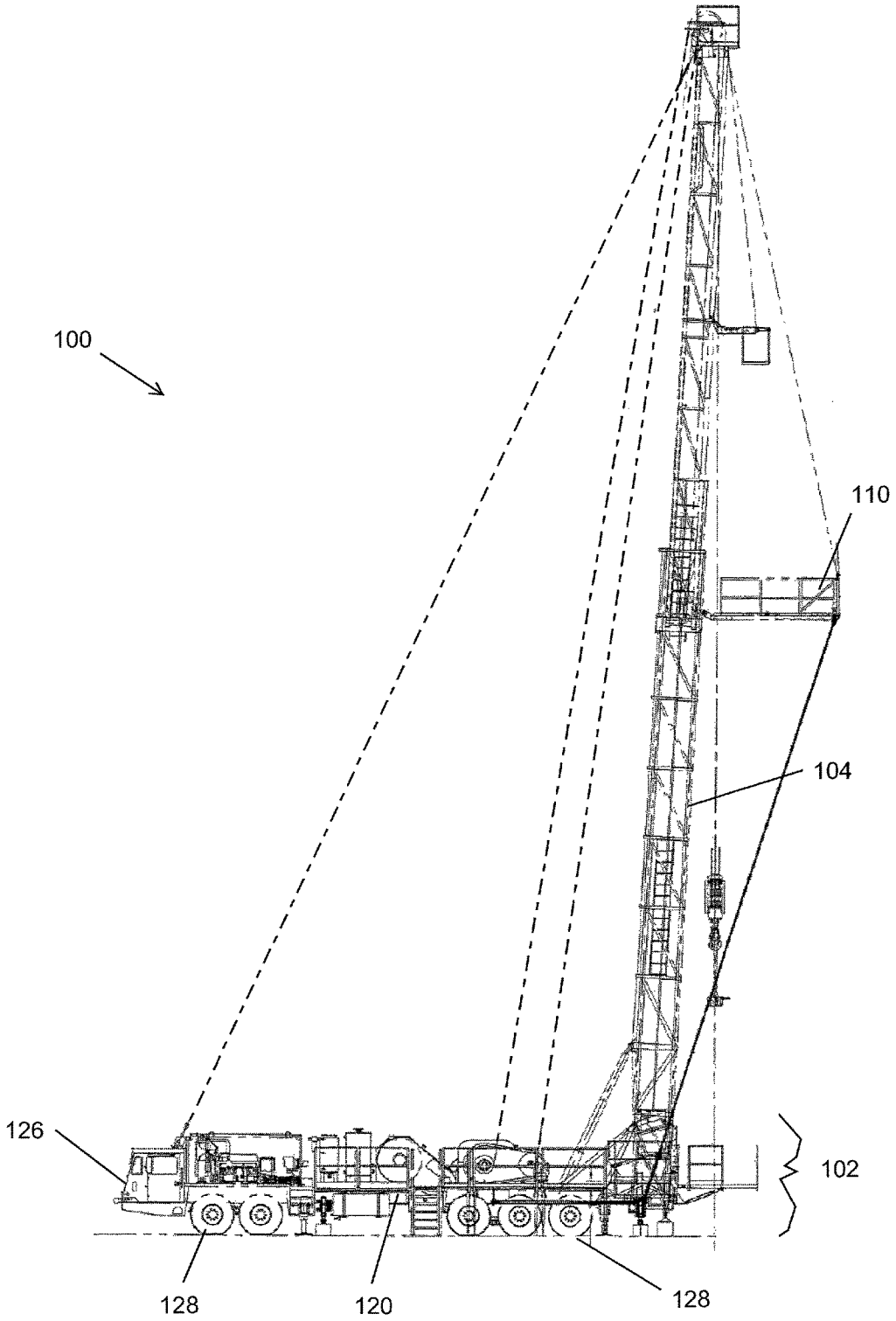
FIG. 1 is a side view of a well servicing rig in an assembled position, according to one or more embodiments.
Figure 2:
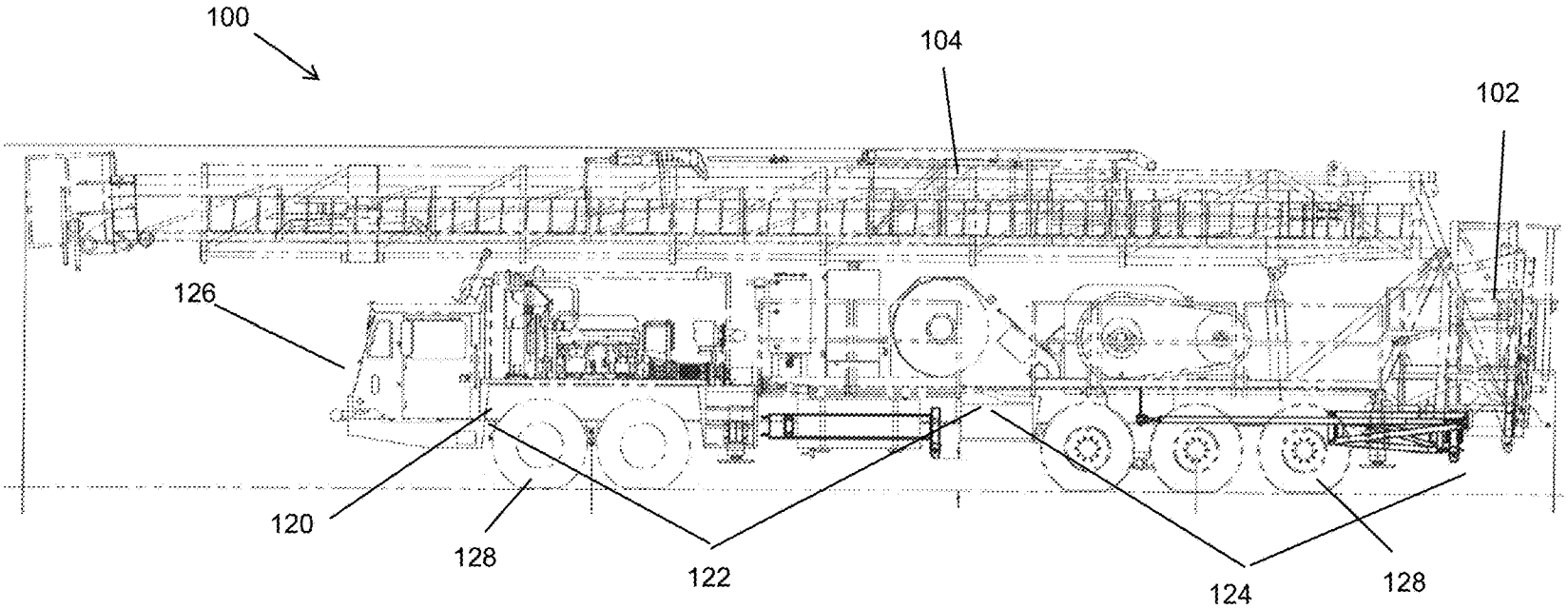
FIG. 2. is a side view of the servicing rig of FIG. 1 in a roading position, according to one or more embodiments.

In FIGS. 1 and 2, a well servicing rig 100 of the present disclosure is shown in an assembled position and a roading position, respectively. As shown, the rig 100 may have a base 102 configured to support a mast 104. In some embodiments, the rig 100 may be a mobile rig, as shown in FIGS. 1 and 2, and thus may be configured for transport between oil well sites. The rig 100 may be mobile, partially mobile, or stationary in different embodiments.

The base 102 may provide support for various equipment, including for example a drawworks, as well as the mast 104. The base 102 may additionally provide a work surface for workers in some embodiments. In some embodiments, the base 102 may be or include a mobile truck, as shown in FIG. 1. In this way, the rig 100, including base 102 and mast 104, may be a mobile unit that may be driven to a well location. The base 102 may include a carrier frame 120 configured to support equipment and the mast 104, and a split base having a cabin portion 126 configured for housing an engine and a driver, and a plurality of tires 128 configured to facilitate movement of the base 102.

Figure 3:
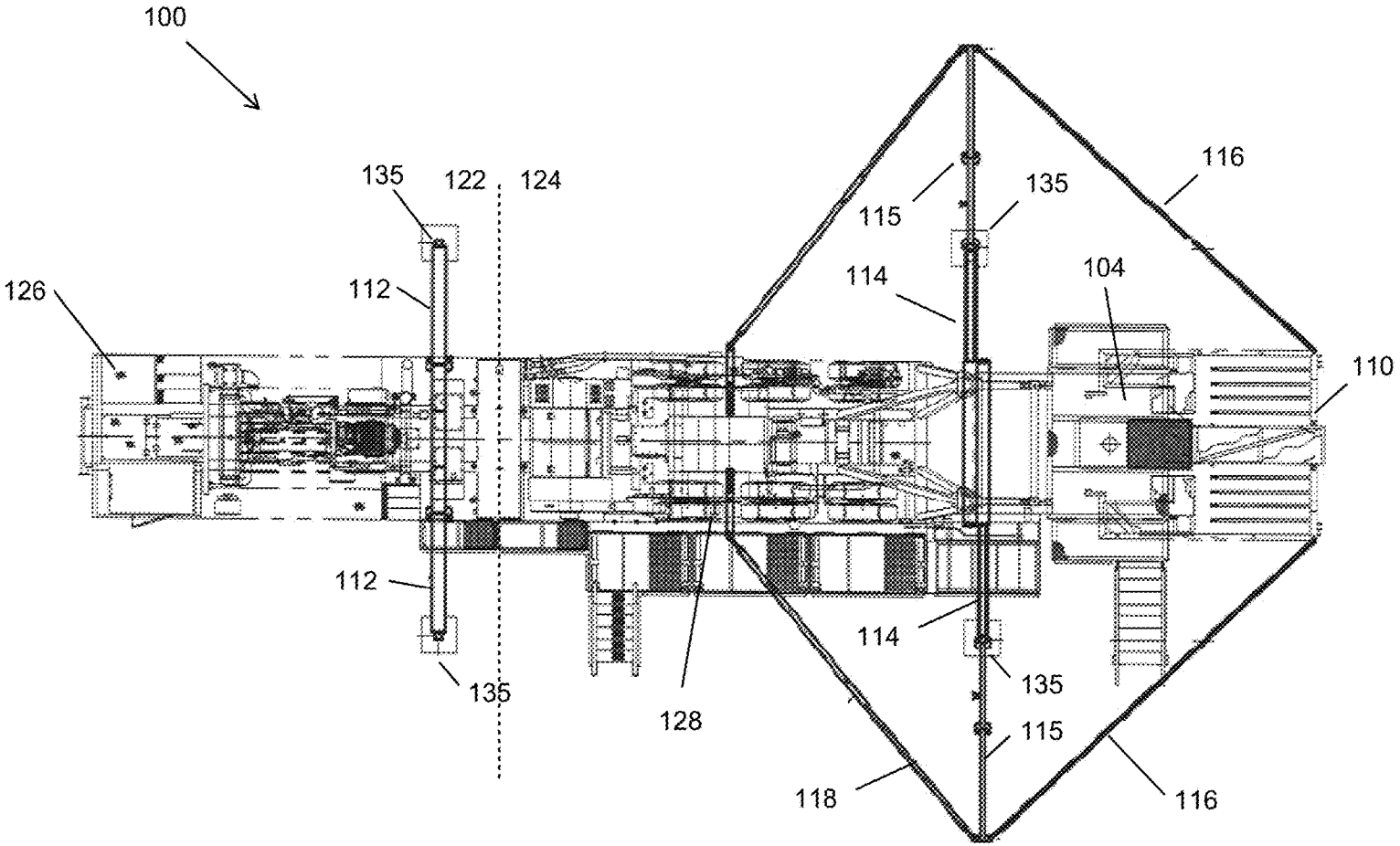
FIG. 3 is an overhead view of the servicing rig of FIG. 1 in an assembled position, according to one or more embodiments.

As shown in FIGS. 2 and 3, the carrier frame 120 may have a generally rectangular shape. In some embodiments, the carrier frame 120 may be configured for roadway or highway driving, and thus may have a width suitable for roadway or highway driving. In other embodiments, the carrier frame 120 may have any suitable width. In some embodiments, the mast 104 may be coupled to the carrier frame 120. Additionally or alternatively, other equipment, such as a drawworks, drilling fluid system equipment, degasser, or other equipment may be positioned on and/or coupled to the carrier frame 120. The carrier frame 120 may have any suitable length to accommodate the mast 104 and/or equipment positioned on the base 102. The length of the carrier frame 120 may be divided into a first portion and a second portion. In some embodiments, the first portion may be a front portion or engine end 122, and the second portion may be a rear portion or mast end 124. In some embodiments, the mast 104 may be positioned at the mast end 124 of the carrier frame 120.

The cabin portion 126 may be positioned at or near the engine end 122 of the carrier frame 120. The cabin portion 126 may be configured for housing an engine and driver to drive the rig 100. In some embodiments, the cabin portion 126 may be or may be similar to a standard semi-trailer truck cabin. In other embodiments, the cabin portion 126 may be any suitable type of cabin and may be configured for roadway or highway driving, for example.

The carrier frame and/or cabin portion 126 may be positioned on a plurality of tires 128. The tires 128 may facilitate movement of the base 102. The plurality of tires 128 may be configured for roadway or highway driving. The base 102 may have 16, 18, or 20 tires 128 in some embodiments. In other embodiments, the base 102 may have any suitable number of tires 128 selected to accommodate highway axle loadings and other transportation rules and standards. In further embodiments, the base 102 may be positioned on a different movement mechanism, such as a track system, or may be positioned on the ground surface, pad drilling surface, or a different surface.

It may be appreciated that in other embodiments, the base 102 may have a different configuration than the truck configuration described above. For example, in other embodiments, the base 102 may be or include a trailer having a plurality of tires and a hitch. In still other embodiments, the base 102 may have a different configuration. The base 102 may be movable by means other than tires or wheels in some embodiments. For example, the base 102 may have walking feet or other means to facilitate movement.

The mast 104 may extend from the base 102 and may provide a structure for a block and tackle system, for example, in order to service the well. The mast 104 may have any suitable erected height. For example, in some embodiments, the mast 104 may have a height of between approximately 50 and approximately 200 feet. Particularly, the mast 104 may have a height of between approximately 50 and approximately 150 feet in some embodiments. More particularly, the mast 104 may have a height of between approximately 75 and approximately 125 feet in some embodiments. The mast 104 may be configured to be assembled and/or erected at a well location. For example, the mast 104 may be a cantilevered mast. That is, the mast 104 may cantilever from the base 102 of the rig 100 and may be configured to be positioned in a lowered roading position, generally parallel with the base, or an erected assembled position, generally perpendicular to the base. FIG. 2 illustrates the mast 104 in a roading position, according to some embodiments. In this way, the mast 104 may be transported to a well site in the roading position and erected to an assembled position at a well site. Additionally or alternatively, the mast 104 may be a telescoping mast. For example, the mast 104 may comprise two or more nesting sections that extend outward from one another. In other embodiments, the mast 104 may have additional or alternative mechanisms for transporting, assembling, and/or erecting. In some embodiments, the mast 104 may have a rod board configured for holding sucker rods.

In some embodiments, the mast 104 may have a racking board 110, as shown in FIG. 1. The racking board 110 may be a cantilevered ledge configured to provide a working platform at a height along the mast. The racking board 110 may generally have a working surface and an outer railing. The racking board 110 may have one or more lugs coupled to a side rail or other element of the racking board for attaching guylines or other components. The racking board 110 may be positioned at any suitable height on the mast 104. For example, in some embodiments, the racking board 110 may be positioned at a height of between approximately 10 and approximately 200 feet above the ground, pad, or other surface on which the rig 100 is positioned. Particularly, the racking board 110 may be positioned at a height of between approximately 20 and approximately 100 feet above the ground, pad, or other surface. More particularly, the racking board 110 may be positioned at a height of between approximately 30 and approximately 70 feet above the ground, pad, or other surface in some embodiments. The racking board 110 may be coupled to the mast 104 via one or more racking board hinges in some embodiments. In other embodiments, the racking board 110 may be coupled to the mast 104 by other mechanisms.

Figure 4:
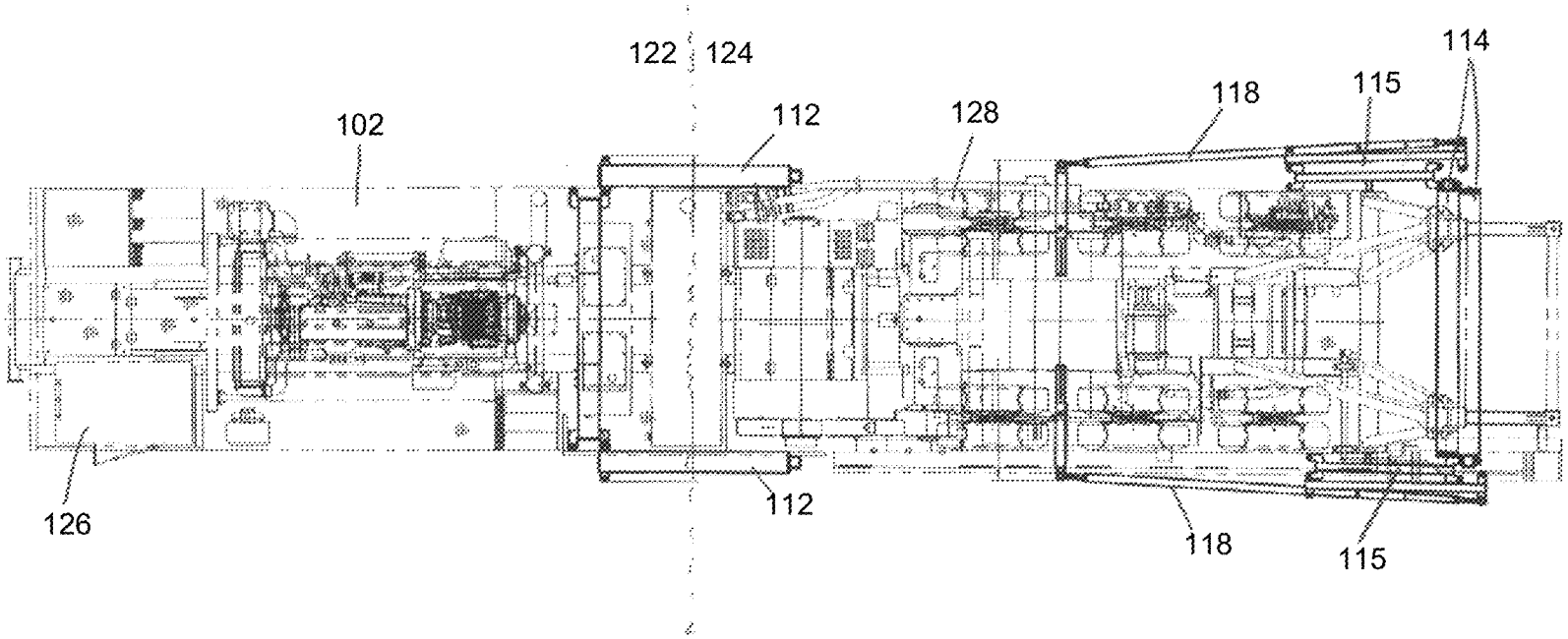
FIG. 4 is an overhead view of the servicing rig of FIG. 1 in a roading position.

Turning now to FIGS. 3 and 4, the rig 100 is shown from an overhead view in an assembled position and a roading position, respectively. In some embodiments, the rig 100 may have a stabilization system comprising a pair of front outriggers 112, a pair of rear outriggers 114, a pair of racking board supports 115, a pair of bracing supports 118, and a pair of internal guylines 116, which may be racking board internal guylines in some embodiments. In the assembled position, the stabilization system may be configured to stabilize the assembled rig 100 against wind loading, jarring forces, and/or other forces. Additionally, the stabilization system may be configured for roading, as shown in FIG. 4, such that the rig 100 may be suitable for transportation on roads, highways, or by other means.

As shown in FIG. 3, the rig 100 may have a pair of front outriggers 112. In the assembled position, the front outriggers 112 may extend laterally from opposing sides of the carrier frame 120 of the base 102. In some embodiments, the front outriggers 112 may extend from an engine end 122 of the carrier frame 120. For example, where the base 102 includes a truck configuration, the front outriggers 112 may be positioned closer to the cabin portion 126 than the mast 104. In other embodiments, the front outriggers 112 may extend from a different position or location of the base 102. In the roading position, the front outriggers 112 may be configured to retract, fold, pivot, or otherwise be positioned for roading, such that the rig 100 may be driven or otherwise transported, as shown for example in FIG. 4.

Figure 5A:
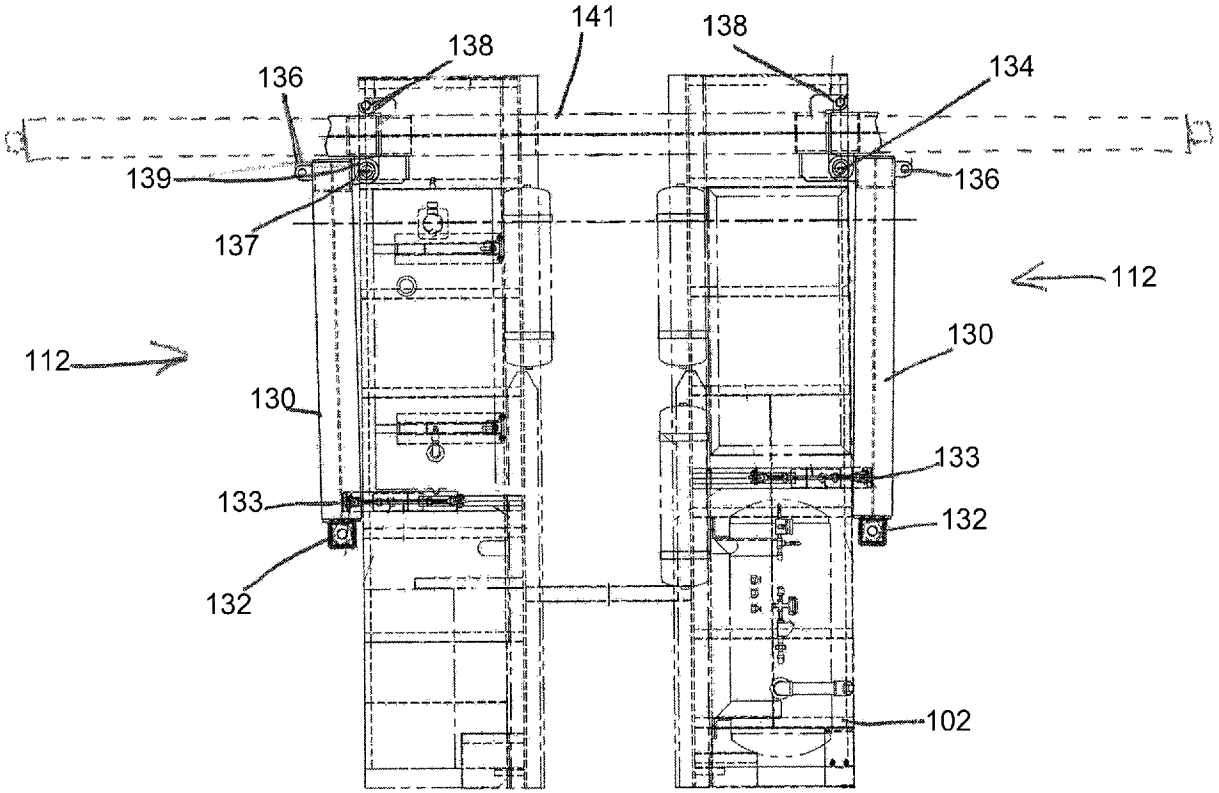
FIG. 5A is a detail overhead view of a pair of front outriggers in a roading position, and alternatively an assembled position, according to one or more embodiments.

FIG. 5A illustrates a detailed view of the front outriggers 112 in the roading position or alternatively in an assembly position. Each front outrigger 112 may have an arm portion 130 configured to extend outward, a foot portion 132 extending from an end of the arm portion, a pivoted connection 134 about which the arm portion pivots, an assembly lug 136 configured for securing the front outrigger in an assembly position, and a roading lug 133 configured for securing the front outrigger in a roading position.

The arm portion 130 may include one or more beams, such as steel beams for example. For example, in some embodiments, each arm portion 130 may comprise a single beam. In other embodiments, each arm portion 130 may comprise multiple coupled beams. Each beam may generally have any suitable shape. For example, the one or more beams of an arm portion 130 may have a square, rectangular, tubular, wide flange, channel, or other suitable beam shape. The arm portion 130 may have a length of between approximately 1 and approximately 20 feet in some embodiments. Particularly, the arm portion 130 may have a length of between approximately 1 and approximately 10 feet in some embodiments. More particularly, the arm portion 130 may have a length of between approximately 4 and approximately 6 feet in some embodiments. Additionally, the arm portion 130 may have any suitable width and height. For example, in some embodiments, the arm portion 130 may include a square beam having a width and height of approximately 12 inches.

Figure 6:
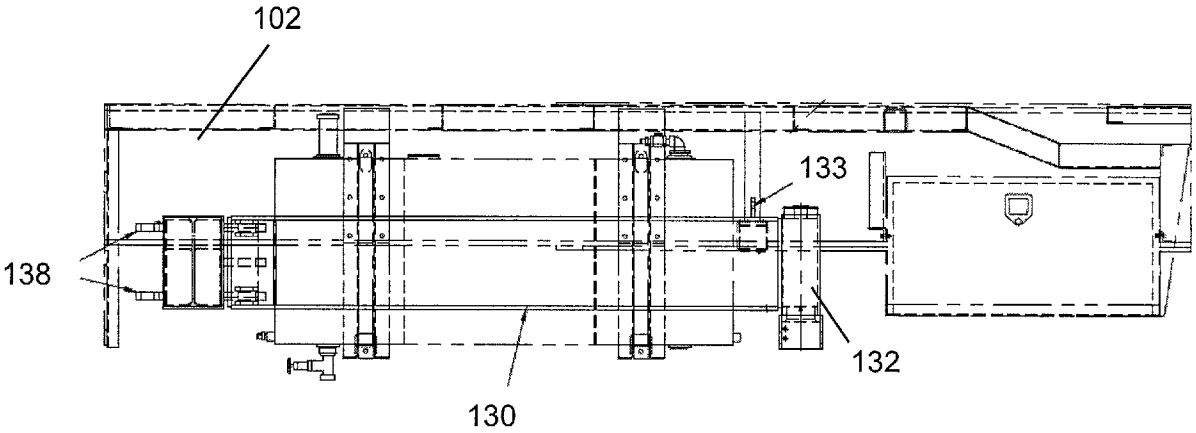
FIG. 6 is a side detail view of a front outrigger of FIG. 5A in a roading position, according to one or more embodiments.

As shown in FIG. 6, the arm portion 130 may be positioned on the base 102 such that the arm portion may be above the ground surface when the arm portion is in either of the assembled or roading positions. The arm portion 130 may be positioned on the base 102 such that a lowest surface, or bottom surface, of the arm portion may be positioned between 4 and 36 inches above the ground surface. Particularly, the arm portion 130 may be positioned such that a lowest surface is between 4 and 24 inches above the ground surface. More particularly, the arm portion 130 may be positioned such that a lowest surface is between 6 and 12 inches above the ground surface when the arm portion is in either of the assembled position or roading position.

As shown in FIG. 5A, the arm portion 130 may be configured to extend outward laterally from the rig 100 in an assembled position and/or to fold inward toward the rig in a roading position. In an assembled position, the arm portion 130 may extend perpendicular or nearly perpendicular to the base 102 of the rig 100 and substantially parallel to the ground. In a roading position, the arm portion 130 may be positioned laterally adjacent to the base 102, such that all or a portion of a longitudinal side of the arm portion may be in contact with the base. Additionally or alternatively, in the roading position, all or a portion of the arm portion 130 may be positioned at a distance from the base 102. For example, as shown in FIG. 5A, in the roading position, the aim portion 130 may be positioned at an angle adjacent to the base 102. Each arm portion 130 of the pair of front outriggers 112 may be positioned such that they are generally aligned with one another. That is, when the front outriggers 112 are in an extended position, the arm portions 130 may be generally aligned across the width of the base 102.

The pivoted connection 134 may couple the arm portion 130 to the base 102 and may allow the arm portion to pivot between the assembled position and the roading position. The pivoted connection 134 may allow the arm portion 130 to rotate approximately 90 degrees in some embodiments. The pivoted connection may include a pin, hinge, or other pivotable device 137, and a pivot lug 139. The pivot lug 139 may extend from an end of the arm portion 130 and may be configured to couple to the pin, hinge, or other pivotable device 137. The pin, hinge, or other pivotable device 137 may pivotably couple the arm portion 130 to the base 102.

The front outriggers 112 may each have an assembly lug 136 configured to maintain the front outrigger in an assembled position. The assembly lug 136 may extend from the arm portion 130. In some embodiments, the assembly lug 136 may extend from an opposing side of the arm portion 130 than the pivot lug 139. The assembly lug 136 may have an eyelet configured to receive a pin, bolt, screw, or other securing device. When the front outrigger 112 is in the assembled position, the assembly lug 136 may meet with an opposing angled lug 138 having an eyelet, such that the eyelets align, allowing a screw, pin, or other device to be passed through the assembly lug and angled lug. This may generally secure the front outrigger 112 in an assembled position, and may help to prevent the outrigger 112 from pivoting inward at its pivoted connection 134. In some embodiments, as shown for example in FIG. 7, the front outrigger 112 may have more than one assembly lug 136 having an eyelet. For example, the outrigger 112 may have four or two assembly lugs 136 in some embodiments. Similarly, the base 102 may have more than one angled lug 138 configured to meet with the assembly lug(s) 136. As shown in FIG. 6 for example, there may be two angled lugs 138 in some embodiments. In some embodiments, each angled lug 138 may be configured to be sandwiched between two assembly lugs 136.

Figure 7:
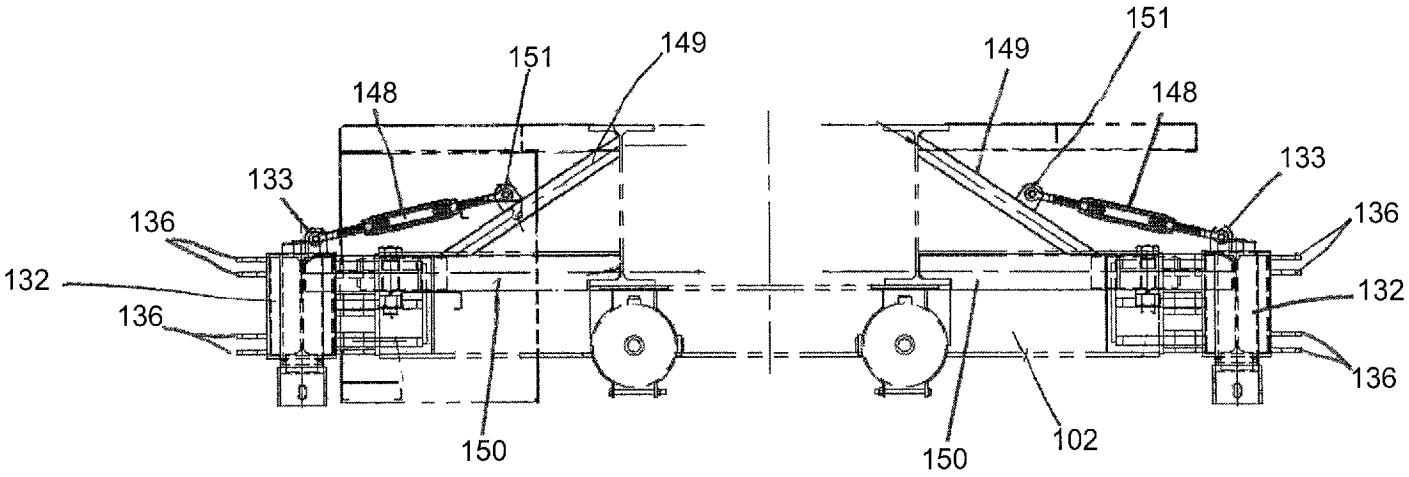
FIG. 7 is an end detail view of the front outriggers of FIG. 5A in a roading position, according to one or more embodiments.

Additionally, as shown in FIGS. 6 and 7, in some embodiments, each front outrigger 112 may additionally have a roading lug 133. The roading lug 133 may extend from the aim portion 130. In some embodiments, the roading lug 133 may extend from an uppermost surface of the arm portion 130, or a surface furthest from the ground surface. The roading lug 133 may be positioned at any suitable point along the length of the arm portion 130. The roading lug 133 may have an eyelet configured to receive a securing device for securing the front outrigger 112 in a roading position, as discussed more fully below.

In some embodiments, each front outrigger 112 may have a foot portion 132. The foot portion 132 may be configured to extend between the arm portion 130 and the ground surface, pad surface, or a pedestal or block surface, for example. The foot portion 132 may couple to the arm portion 130 at or near an end, such as the outermost end when the arm portion is in an assembled position. The foot portion 132 may be coupled to the arm portion 130 at the outermost end of the arm portion, furthest from the base 102, such that the foot portion extends outward from the arm portion. In other embodiments, the foot portion 132 may be coupled to the arm portion 130 at a different location. The foot portion 132 may be coupled to the arm portion 130 using welding or other suitable coupling means. The foot portion 132 may have any suitable shape, and in some embodiments may have a generally tubular or rectangular shape. When coupled to the arm portion 130, the foot portion 132 may have a length extending from at or near an upper surface of the arm portion, to a pad surface or ground surface in some embodiments. In some embodiments, the length of the foot portion 132 extending below the arm portion 130 may be adjustable using a jackscrew or other mechanism, such that for example, the foot portion 132 may be shortened for a roading position and/or lengthened to meet a ground, pad, pedestal, block, or other surface.

In some embodiments, the foot portion 132 may be positioned on a block or pedestal 135, as shown in FIG. 3. Each pedestal 135 may be composed of wood, concrete, steel, plastic, and/or other suitable materials. The pedestals 135 may generally be positioned on the ground, pad, or other surface on which the rig 100 is positioned. The pedestals 135 may be configured to provide a level or near level surface on which each of the foot portions 132 may be positioned. The pedestals 135 may have any suitable height. For example, in some embodiments, the pedestals 135 may have a height of between 1 and 60 inches. Particularly, in some embodiments, the pedestals 135 may have a height of between 1 and 36 inches. More particularly, the pedestals 135 may have a height of between 12 and 24 inches in some embodiments. Further, the pedestals 135 may have any suitable shape so as to provide a flat surface for the foot portions 132. For example, the pedestals 135 may have a cubed or rectangular shape, as shown in FIG. 3. Other shapes may be suitable as well. The pedestals 135 may have any suitable width and depth.

Figure 8A:
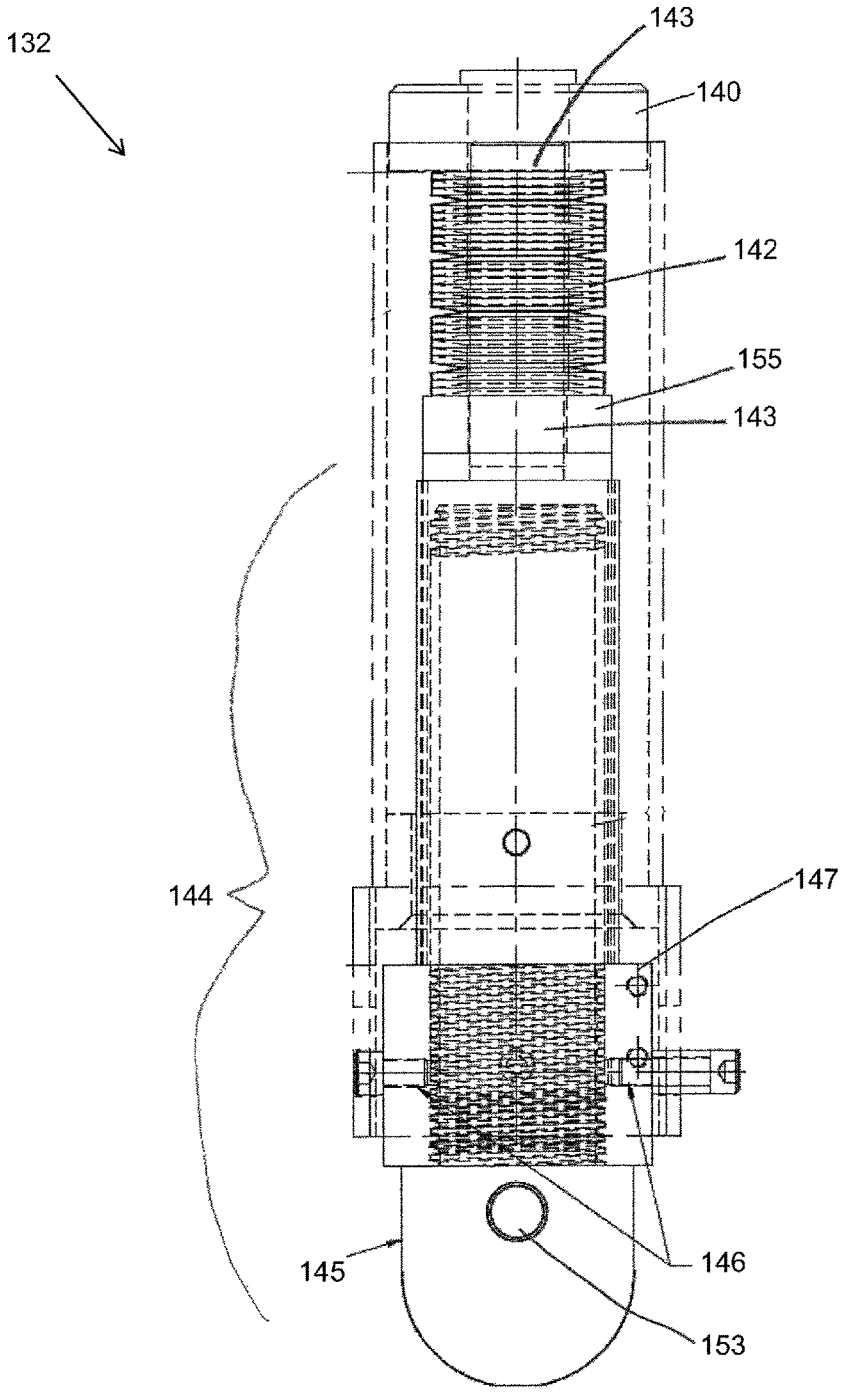
FIG. 8A is an internal view of a front outrigger foot portion, according to one or more embodiments.

Turning now to FIG. 8A, the foot portion 132 is shown in detail. The foot portion 132 may generally be configured to extend between the arm portion 130 and the ground surface, pad surface, pedestal, block, or other surface. The foot portion 132 may include an outer sheath 140 housing a jackscrew 144, a plurality of washers 142 positioned about an inner post 143, and a spacer 155.

The outer sheath 140 may be a steel or other material casing configured to house the plurality of washers 142 and jackscrew 144 in some embodiments. The outer sheath 140 may have a generally tubular shape in some embodiments. The outer sheath 140 may be configured to protect the washers 142 and jackscrew 144 from dirt and other elements. The outer sheath 140 may have any width or diameter suitable for housing the jackscrew 144 and washers 142.

The jackscrew 144 may generally be configured to lengthen and shorten. That is, the jackscrew 144 may lengthen to elongate the length of the foot portion 132, for example. In this way, the foot portion 132 may be extended or shortened to accommodate different ground surface, pad surface, pedestal, block, or other surfaces positioned beneath the front outriggers 112. In some embodiments, the jackscrew 144 may have a threaded foot 145 and a threaded casing 147.

The threaded foot 145 may be or include a tubular portion having threads and configured for engaging with the threaded casing 147. The threaded foot 145 may further be configured for positioning the foot portion 132 on the ground, pad, block, pedestal, or other surface. In some embodiments, the threaded foot 145 may have a rounded end portion for positioning on the ground, pad, pedestal, block, or other surface. Such rounded surface may provide for a contact with a ground, pad, pedestal, block, or other surface while mitigating point or line loading issues that may arise with a flat-bottomed surface. In some embodiments, a base plate, jack stand, pedestal, block, or other surface may have a spherical radius configured to mate with the rounded end of the foot threaded foot 145. The threaded foot 145 may have any suitable length. For example, in some embodiments, the threaded foot 145 may have a length of between 1 and 36 inches. Particularly, in some embodiments, the threaded foot 145 may have a length of between 6 and 18 inches.

The threaded foot 145 may couple to the threaded casing 147 by threading. That is, for example, the threaded casing 147 may be an otherwise hollow tube lined with threading and configured to receive the threaded foot 145. The threaded casing 147 may have any suitable length and may generally have a length suitable for receiving the threaded foot 145. Each of the threaded foot 145 and threaded casing 147 may be composed of steel or other suitable materials. In some embodiments, the threaded foot 145 may include an eyelet 153 configured to receive a round bar or other device to facilitate movement of the foot portion 132, such as rotation on its threading into or out of the threaded casing 147, thereby lengthening or shortening the jackscrew 144.

In some embodiments, a capscrew 146 may be arranged in communication with the jackscrew 144 and outer sheath 140. That is, the outer sheath 140 and jackscrew 144 may each have two aligned openings, wherein the openings of the sheath are configured to align with the openings of the jackscrew. The openings may further be configured to receive a capscrew 146 passing through the outer sheath 140 and jackscrew 144. The capscrew 146 may be configured to help position the jackscrew 144 within the outer sheath 140 and may mitigate or prevent separation of the jackscrew from the outer sheath.

The plurality of washers 142 may be rounded or curved washers, such as Belleville washers, in some embodiments. The plurality of washers 142 may include any suitable number of washers. For example, in some embodiments, between 1 and 50 washers may be used. Particularly, between 10 and 40 washers may be used in some embodiments. More particularly, between 20 and 30 washers may be used in some embodiments. The washers 142 may be arranged in a stacked configuration about the inner tube 143. The washers 142 may be stacked with curves facing opposing directions, thus alternating concave and convex washers. For example, as shown in FIG. 8A, the washers 142 may be stacked in groups of three, with each group of three alternating whether the arc of the washers is concave or convex. By alternating stacks of concave and convex washers 142, the plurality of washers may operate as a spring mechanism. That is, for example, when a load acts on the stack of washers 142, the stack may compress together as the curved washers deform by flattening. The stack of washers 142 may thus produce a reaction force. In other embodiments, the washers 142 may be stacked or arranged differently.

The inner post 143 may be a metal or other material cylinder configured to receive the plurality of washers 142. For example, the inner post 143 may have a diameter slightly smaller than an inner diameter of the washers 142. The inner post 143 may couple to the threaded casing 145 in some embodiments.

The spacer 155 may be positioned between the jackscrew 144 and plurality of washers 142 in some embodiments. For example, the spacer 155 may be positioned about the inner post 143 between the jackscrew 144 and washers 142. The spacer 155 may generally be configured to provide a barrier between the jackscrew 144 and washers 142. The spacer may be composed of metal, plastic, wood, or other suitable materials.

In some embodiments, the foot portion 132 may be configured to respond or react to an applied load, such as wind loading acting on the oil rig 100. For example, as the rig 100 leans to one side, such as from wind loading, the foot portion 132 on that side of the rig 100 may become loaded. As the load is applied to the foot portion 132, the jackscrew 144 may be configured to push against the spacer 155 and plurality of washers 142. As the force is applied to the washers 142, they may be configured to flex or flatten, particularly where the washers are Belleville or otherwise curved or rounded washers. The washers 142 may in turn be configured to produce a reaction force as the washers resist the flexing or flattening.

Figure 5B:
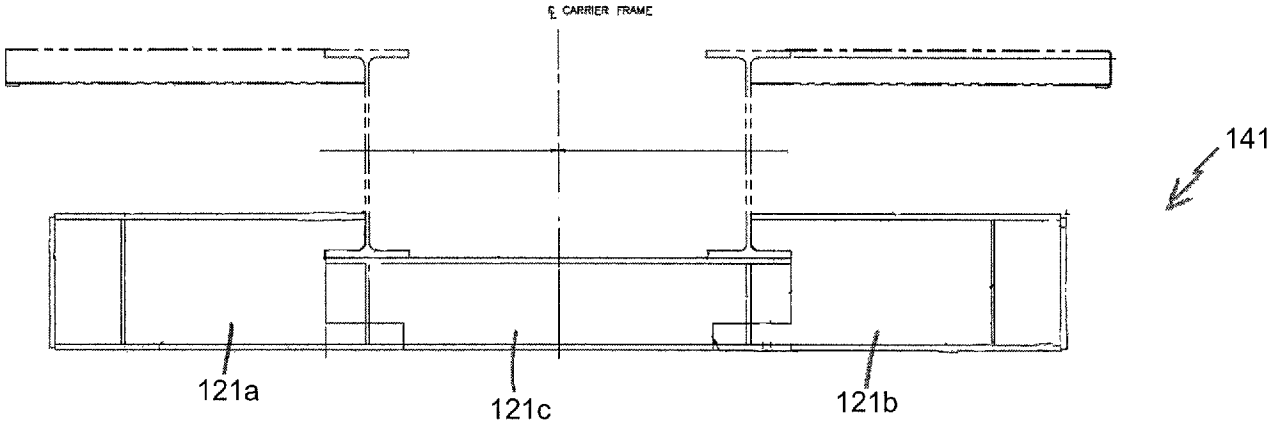
FIG. 5B is a detail end view of an intermediate beam portion of FIG. 5A, according to one or more embodiment.

Turning back to FIG. 5A, in some embodiments, an intermediate beam portion 141 may be positioned between the two front outriggers 112. In some embodiments, the inter mediate beam portion 141 may be coupled to the carrier frame 120. The intermediate beam portion 141 may comprise of one or more steel or other material beams. As shown for example in FIG. 5B, the intermediate beam portion 141 may have two end portions 121*a*, 121*b* and a central portion 121*c* configured to couple to the carrier frame 120. The three portions 121*a*, 121*b*, 121*c* may have any suitable cross sectional shapes, such as a square, rectangular, tubular, wide flange, or other beam shape. The intermediate beam portion 141, including each portion 121*a*, 121*b*, 121*c*, may have any suitable length configured to extend between the two front outriggers 112. In some embodiments, the intermediate beam portion 141 may be configured to be positioned at least partially beneath the carrier frame 120. For example, the intermediate beam portion 141 may be configured such that the carrier frame 120 is configured to be arranged over the central portion 121*c* and between the two end portions 121*a*, 121*b*. The intermediate beam portion 141 may additionally be configured to couple to the two arm portions 130, such that the arm portions may extend outward from the intermediate beam portion when the front outriggers 112 are in an assembled position. Particularly, an arm portion 130 may be configured to extend from each end portion 121*a*, 121*b*. The intermediate beam end portions 121*a*, 121*b* and arm portions 130 may be configured to align to facilitate transference of forces between the arm portions and intermediate beam portion 141. Angled lug(s) 138, discussed above and configured to couple to the locking thumb(s) 136 of the outriggers 112, may extend from the outer portions 121*a*, 121*b* in some embodiments, so as to couple the end portions to the arm portions 130. Additionally or alternatively, the front outriggers 112 may couple to the intermediate beam portion 141 using other coupling mechanisms. The intermediate beam portion 141 may provide stability or support for the outriggers 112 when they are extended in an assembled position. The intermediate beam portion 141 and coupling mechanisms may be configured such that when the front outriggers 112 are coupled to the intermediate beam portion, space between each outrigger and the beam portion may be minimal. It may be appreciated that tight coupling to the intermediate beam portion 141 may provide for a bending resistance for the outriggers 112 so as to minimize vertical movement of the front outriggers with respect to the rig 100 and transfer of the shear and bending forces from the outriggers to the rig.

In the assembled position, the distance between the foot portions 132 of the front outriggers 112 may be between approximately 5 and approximately 50 feet in some embodiments. Particularly, the distance between the foot portions 132 may be between approximately 10 and approximately 30 feet in some embodiments. More particularly, the distance between the foot portions 132 may be between approximately 15 and approximately 25 feet in some embodiments. In other embodiments, the distance between the foot portions 132 when the outriggers 112 are in an assembled position may be any suitable distance.

With reference to FIGS. 5 and 7, in some embodiments, a securing system may be used to secure the front outriggers when in the roading position. For example, a connector 148 may secure each front outrigger 112 to the base 102 when in the roading position. The connector 148 may be or include a turnbuckle in some embodiments. In other embodiments, the connector 148 may include other coupling or securing mechanisms, such as ropes, cords, hooks, or other mechanisms. The connector 148 may couple to the front outrigger 112 via the roading lug 133, described above, or a different mechanism. At an opposing end, the connector 148 may couple to another lug or connection point 151 positioned on the base. In some embodiments, the connection point 151 may be positioned on an angled member 149, as shown in FIG. 7. The angled member 149 may be a steel or other material member positioned on the base 102. The angled member 149 may be angled to extend upward and toward a center of the base 102 between the two outriggers 112. The angled member 149 may be configured to position the connection point 151 for the connector 148 to couple to the base 102. In some embodiments, each angled member 149 may couple to a support member 150 at one end, such as an end nearest the front outrigger 112. The support member 150 may be a steel or other material member extending between the two outriggers 112 when in a roading position. The support member 150 may be configured to stabilize the angled members 149 in some embodiments. Additionally or alternatively, the support member 150 may couple at each end to each arm portion 130 via one or more lugs or other coupling mechanisms when the arm portions are in the roading position. In this way, the support members 150 may help to hold the arm portions 130 in the roading position. In other embodiments, other components or mechanisms may be used to maintain the arm portions 130 in the roading position during roading.

In the roading position, the distance between the outermost points of the front outriggers 112, that is the points extending furthest out from each side of the base 102, may be between 5 and 40 feet in some embodiments. Particularly, the distance between the outermost points may be between 5 and 20 feet in some embodiments. More particularly, the distance between the outermost points may be between 7 and 15 feet in some embodiments. In this way, it may be appreciated that the oil rig 100 in a roading position may have a suitable width for driving or hauling on highways or other roads, for example. In other embodiments, the distance between the outermost points when the outriggers 112 are in a roading position may be any suitable distance.

Referring back to FIG. 3, the stabilization system of the rig 100 may include a pair of rear outriggers 114. In the assembled position, the rear outriggers 114 may extend laterally from opposing sides of the carrier frame 120 of the base 102. In some embodiments, the rear outriggers 114 may extend from a mast end 124 of the carrier frame 120. For example, in some embodiments, the rear outriggers 114 may be positioned nearest an end or portion of the base 102 from which the mast 104 extends. In other embodiments, the rear outriggers 114 may extend from a different position or location of the base 102. In the roading position, the rear outriggers 114 may be configured to retract, fold, pivot, or otherwise be positioned for roading, such that the rig 100 may be driven or otherwise transported.

Figure 9:
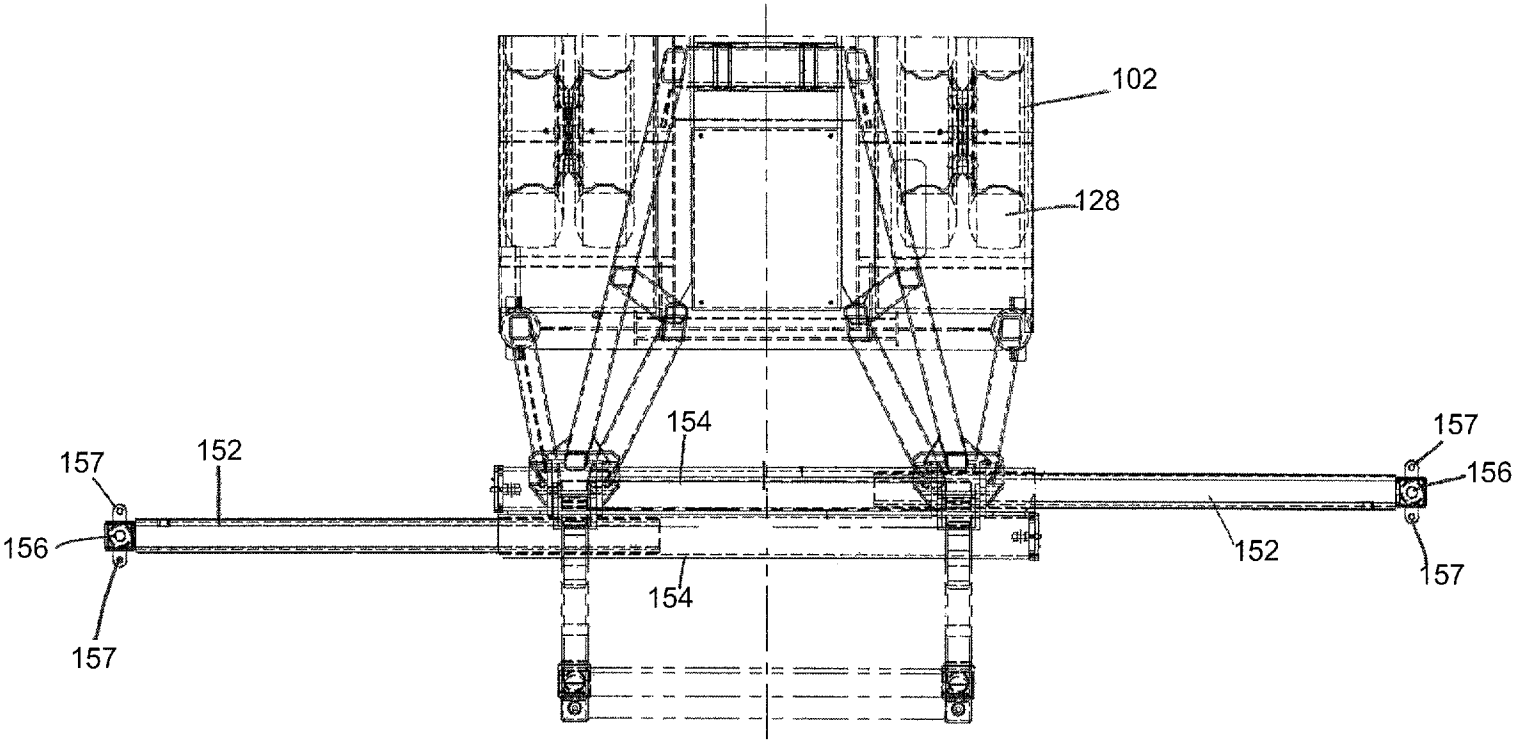
FIG. 9 is an overhead detail view of a pair of rear outriggers in an assembled position, according to one or more embodiments.
Figure 10:
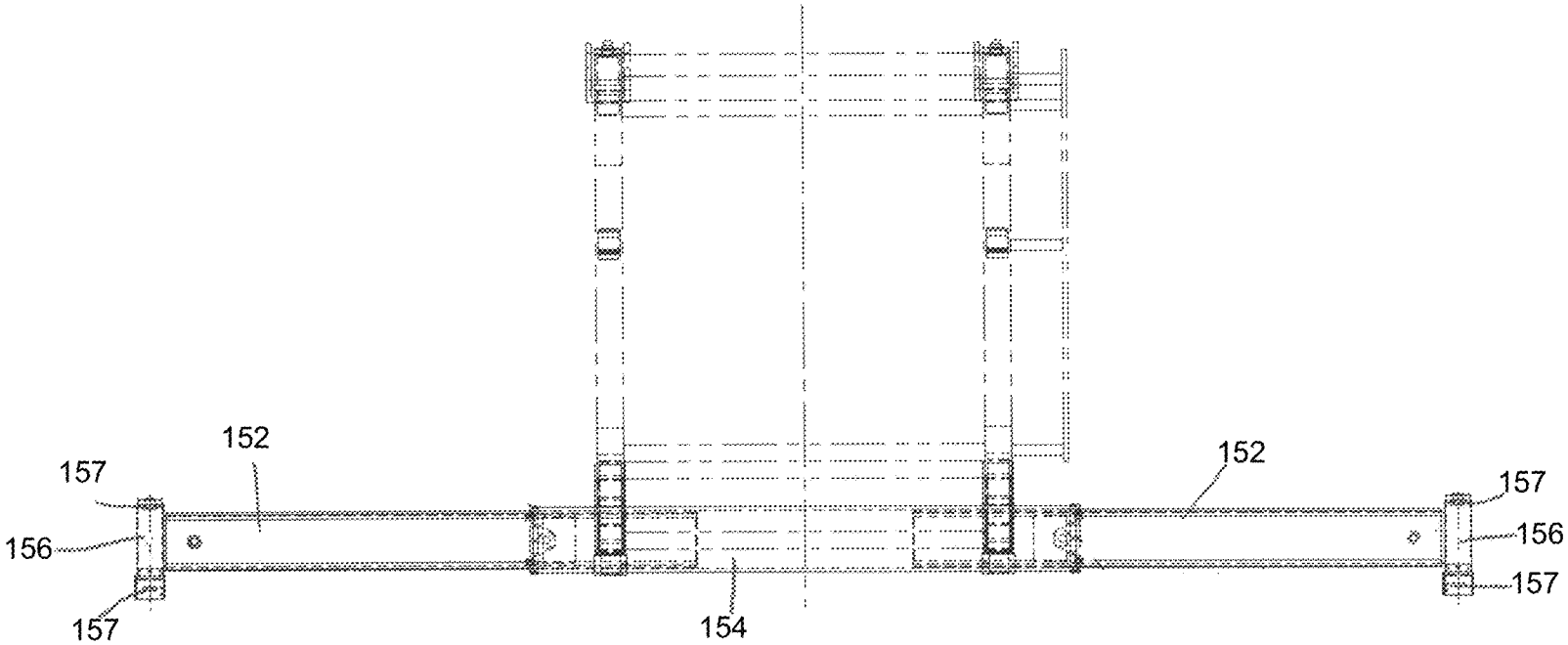
FIG. 10 is an end detail view of the rear outriggers of FIG. 9 an assembled position, according to one or more embodiments.
Figure 11:
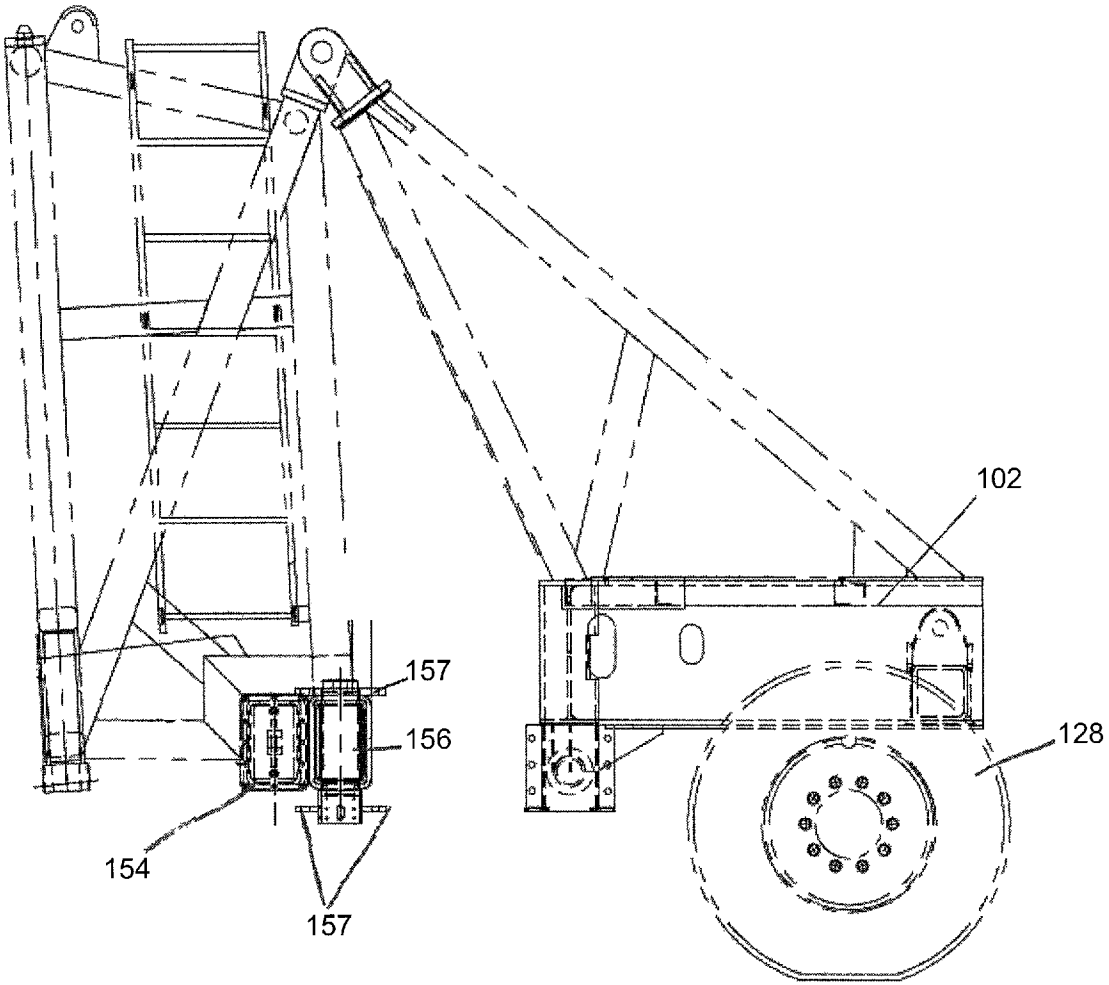
FIG. 11 is a side detail view of the rear outriggers of FIG. 9 in an assembled position, according to one or more embodiments.

FIGS. 9-11 illustrate detailed views of the rear outriggers 114 in an extended position. Each rear outrigger 114 may have a telescoping arm 152 configured to extend outward from the base 102, an outer tube 154 from which the telescoping arm extends and configured to house the telescoping member in the roading position, and a foot portion 156 extending from an end of the telescoping arm.

The telescoping arm 152 may include one or more beams, such as steel beams, for example. For example, in some embodiments, each telescoping arm 152 may comprise a single beam. In other embodiments, each telescoping arm 152 may comprise multiple coupled beams. Each beam may generally have any suitable shape. For example, the one or more beams of a telescoping arm 152 may have a square, rectangular, tubular, wide flange, channel, or other suitable beam shape. The telescoping arm 152 may have a length of between 1 and 20 feet in some embodiments. Particularly, the telescoping arm 152 may have a length of between approximately 5 and approximately 15 feet in some embodiments. More particularly, the telescoping arm 152 may have a length of between approximately 7 and approximately 15 feet in some embodiments. Additionally, the telescoping arm 152 may have any suitable width and height. For example, the telescoping arm 152 may include a square beam having a width and height of approximately 12 inches.

As shown in FIG. 11, the telescoping arm 152 may be positioned on the base 102 such that the telescoping aim may be above the ground surface, pad surface, or other surface on which the rig 100 is positioned when the telescoping arm is extended in the assembled position. In some embodiments, the telescoping arm 152 may be positioned on the base 102 such that a lowest surface, or bottom surface, of the telescoping arm may be positioned between 4 and 36 inches above the ground surface when in an extended position. More particularly, the telescoping arm 152 may be positioned such that a lowest surface is between 6 and 12 inches above the ground surface when the telescoping arm is in the assembled position. In other embodiments, the telescoping arm 152 may be positioned on the base 102 at a greater height. For example, in some embodiments, the telescoping arm 152 may be positioned such that a lowest surface, or bottom surface, of the telescoping arm may be positioned between 36 and 96 inches above the ground surface when the telescoping arm is in the assembled position.

The telescoping arm 152 may be configured to telescope between a retracted roading position and an extended assembled position. In the extended assembled position, as shown in FIGS. 9 and 10, the telescoping arm 152 may extend from a side of the base 102 of the rig 100. In the roading position, the telescoping arm 152 may be drawn inward from the assembled position such that it is positioned across the width of the base 102. The telescoping arm 152 may operate via a hydraulic, pneumatic, or other device in some embodiments. Each telescoping arm 152 of a pair of rear outriggers 114 may be positioned such that the arms may be offset from one another when viewed from an overhead perspective, as shown for example in FIG. 9. That is, for example, the telescoping arms 152 may be positioned adjacent to one another such that a first telescoping arm is positioned closer to the mast 104 than a second telescoping aim. This may allow the telescoping arms 152 to be positioned a same distance from the ground surface, and additionally allow the lengths of both telescoping arms 152 to be withdrawn into the roading position. As shown from an end view of the rig 100, for example in FIG. 10, the telescoping arms 152 may align horizontally or be positioned adjacent to one another, such that each arm is positioned at the same distance above the ground, pad, or other surface on which the rig 100 may be positioned. In other embodiments, the telescoping arms 152 may be arranged differently with respect to one another. For example, a first telescoping arm 152 may be positioned above or on top of a second telescoping arm. It may be appreciated that where the telescoping arms 152 are stacked or positioned at differing heights from the ground surface, the foot portions 156 may be arranged with differing lengths while in an assembled position.

An outer tube 154 may provide a housing or casing for the telescoping arm 152. The outer tube 154 may be a steel or other material casing configured to receive the telescoping arm 152. For example, when the telescoping arm 152 is in the roading position, the arm may be partially or fully encased within the outer tube 154. The telescoping arm 152 may extend fully or partially from the outer tube 154 in the assembled position. The outer tube 154 may have a width and depth larger than that of the telescoping arm 152, such that the telescoping arm may be positioned within the outer tube. In some embodiments, the outer tube 154 may have a length equal or similar to that of the telescoping arm 152. For example, the outer tube 154 may have a length of between 1 and 20 feet in some embodiments. Particularly, the outer tube 154 may have a length of between 5 and 15 feet in some embodiments. More particularly, the outer tube 154 may have a length of between 7 and 15 feet in some embodiments.

In some embodiments, each rear outrigger 114 may have a foot portion 156. The foot portion 156 may be configured to extend between the telescoping arm 152 and the ground surface. The foot portion 156 may couple to the telescoping arm 152 at or near an end, such as the outermost end when the telescoping arm is in an assembled position. The foot portion 156 may be coupled to the telescoping am' 152 at the outermost end of the telescoping arm, furthest from the base 102, such that the foot portion extends outward from the telescoping arm. In other embodiments, the foot portion 156 may be coupled to the telescoping arm 152 at a different location. The foot portion 156 may be coupled to the telescoping arm 152 using welding or other suitable coupling means. The foot portion 156 may have any suitable shape, and in some embodiments may have a generally tubular or rectangular shape. When coupled to the telescoping arm 152, the foot portion 156 may have a length extending from at or near an upper surface of the telescoping arm, to a pad surface or ground surface in some embodiments. In some embodiments, the length of the foot portion 156 extending below the telescoping arm 152 may be adjustable using a jackscrew or other mechanism, such that for example, the foot portion may be shortened for a roading position. In some embodiments, the foot portion 156 may have one or more lugs 157 extending from the foot portion, as shown for example in FIG. 9. For example, each foot portion 156 may have one lug 157 extending from each of two opposing sides of the foot portion. In some embodiments, each foot portion 156 may have two lugs 157 extending from each of two opposing sides of the foot portion. The lugs 157 may be configured for coupling additional equipment to the rear outriggers 114. The foot portion 156 may be configured to be positioned on a ground surface, pad surface, block surface, pedestal surface, or other surface. For example, each foot portion 156 may be positioned on a pedestal 135, as described above with respect to foot portions 132. As previously described, pedestals 135 may be configured to provide a level or nearly level surface on which foot portions 156 may be positioned.

Figure 8B:
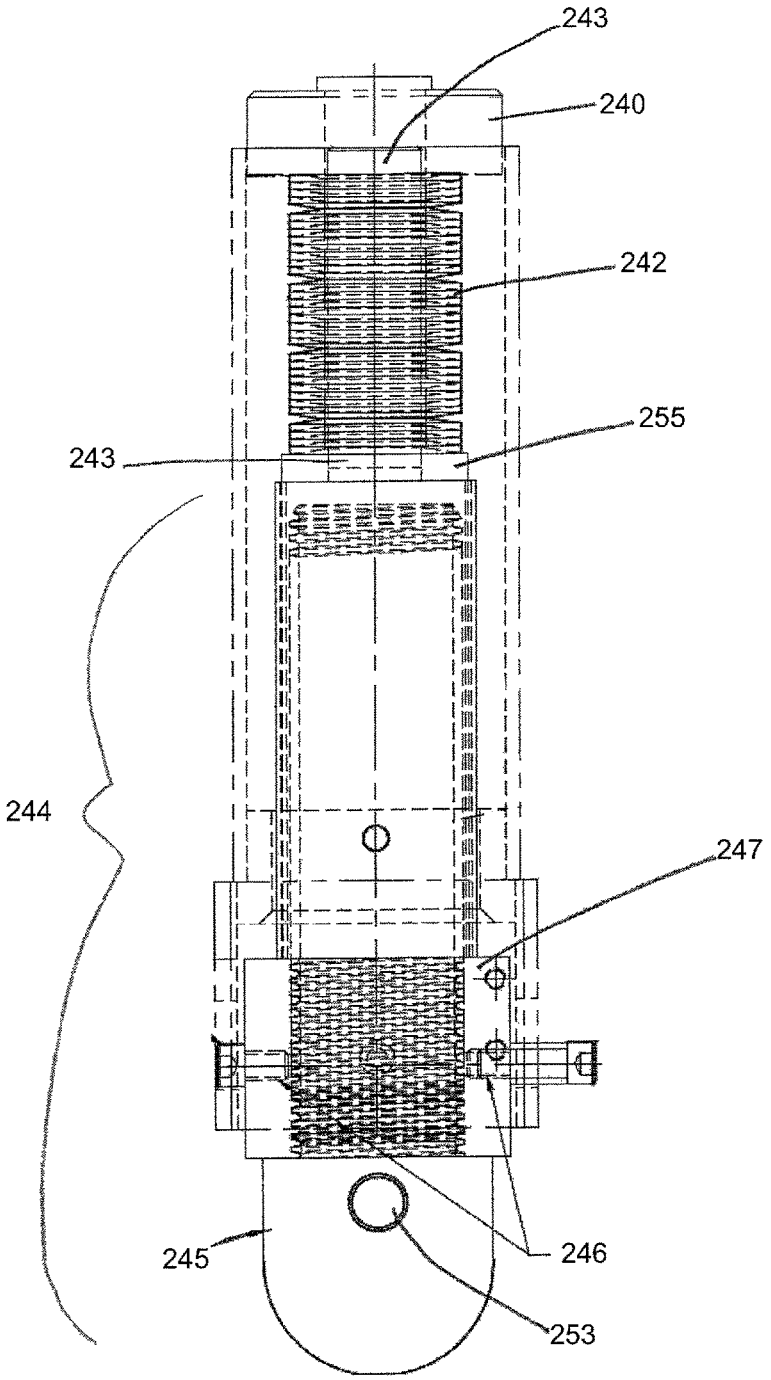
FIG. 8B is an internal view of a rear outrigger foot portion, according to one or more embodiments.

In some embodiments, the foot portion 156 may be similar to the foot portions 132 of the front outriggers 112, as described above. FIG. 8B illustrates a detailed view of a foot portion 156 that may be positioned on a rear outrigger 114. The foot portion 156 may include an outer sheath 240 housing a jackscrew 244, a plurality of washers 242 positioned about an inner post 243, and a spacer 255. The outer sheath 240, jackscrew 244, inner post 243, and spacer 255 may be the same or similar as described above with respect to foot portion 132. For example, the jackscrew 244 may be configured for lengthening and shortening the foot portion 156, and may have a threaded foot 245 and a threaded casing 247. Further eyelet 253 may be configured to receive a round bar or other element to facilitate turning the foot portion 245 for lengthening or shortening the jackscrew 244. A capscrew 246 may be positioned through the outer sheath 240 and jackscrew 244 as described above.

The plurality of washers 242 may be rounded or curved washers, such as Belleville washers, in some embodiments. The plurality of washers 242 may include any suitable number of washers. For example, in some embodiments, between 1 and 50 washers 242 may be used. Particularly, between 10 and 40 washers 242 may be used in some embodiments. More particularly, between 20 and 30 washers 242 may be used in some embodiments. The washers 242 may be arranged in a stacked configuration about the inner tube 243. The washers 242 may be stacked with curves facing opposing directions, thus alternating concave and convex washers. For example, as shown in FIG. 8B, the washers 242 may be stacked in groups of four, with each group of four alternating whether the arc of the washers is concave or convex. By alternating stacks of concave and convex washers 242, the plurality of washers may operate as a spring mechanism. That is, for example, when a load acts on the stack of washers 242, the stack may compress together as the curved washers deform by flattening. The stack of washers 242 may thus produce a reaction force. In other embodiments, the washers 242 may be stacked or arranged differently.

In some embodiments, the foot portion 156 may be configured to respond or react to an applied load, such as wind loading acting on the oil rig 100, similar to foot portion 132. For example, as the rig 100 leans to one side, such as from wind loading, the foot portion 156 on that side of the rig 100 may become loaded. As the load is applied to the foot portion 156, the jackscrew 244 may be configured to push against the spacer 255 and plurality of washers 242. As the force is applied to the washers 242, they may be configured to flex or flatten, particularly where the washers are Belleville or otherwise curved or rounded washers. The washers 242 may in turn be configured to produce a reaction force as the washers resist the flexing or flattening.

In the assembled position, the distance between the foot portions 156 of the rear outriggers 114 may be between approximately 5 and approximately 50 feet in some embodiments. Particularly, the distance between the foot portions 156 may be between approximately 10 and approximately 30 feet in some embodiments. More particularly, the distance between the foot portions 156 may be between approximately 15 and approximately 25 feet in some embodiments. In other embodiments, the distance between the foot portions 156 when the outriggers 114 are in an assembled position may be any suitable distance.

In the roading position, the distance between the outermost points of the rear outriggers 114, that is the points extending furthest out from each side of the base 102, may be between 5 and 40 feet in some embodiments. Particularly, the distance between the outermost points may be between 5 and 20 feet in some embodiments. More particularly, the distance between the outermost points may be between 7 and 15 feet in some embodiments. In this way, it may be appreciated that the oil rig 100 in a roading position may have a suitable width for driving or hauling on highways or other roads, for example. In other embodiments, the distance between the outermost points when the outriggers 114 are in a roading position may be any suitable distance.

Referring back to FIG. 3, in some embodiments, the stabilization system of the rig 100 may include a pair of racking board supports 115. In the assembled position, a racking board support 115 may extend outward from each of the rear outriggers 114 in some embodiments. In other embodiments, the racking board supports 115 may extend from a different location on the rig 100. In the roading position, the racking board supports 115 may be configured to retract, fold, pivot, or otherwise be positioned for roading, such that the rig 100 may be driven or otherwise transported.

Figure 12:
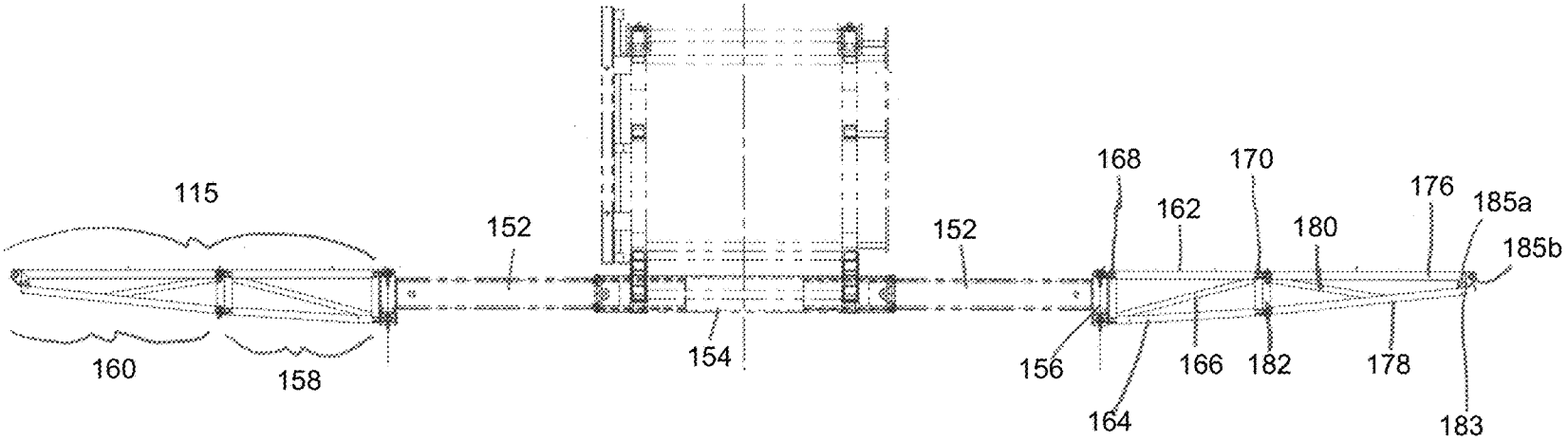
FIG. 12 is an end detail view of a pair of rear outriggers and racking board supports in an assembled position, according to one or more embodiments.
Figure 13:
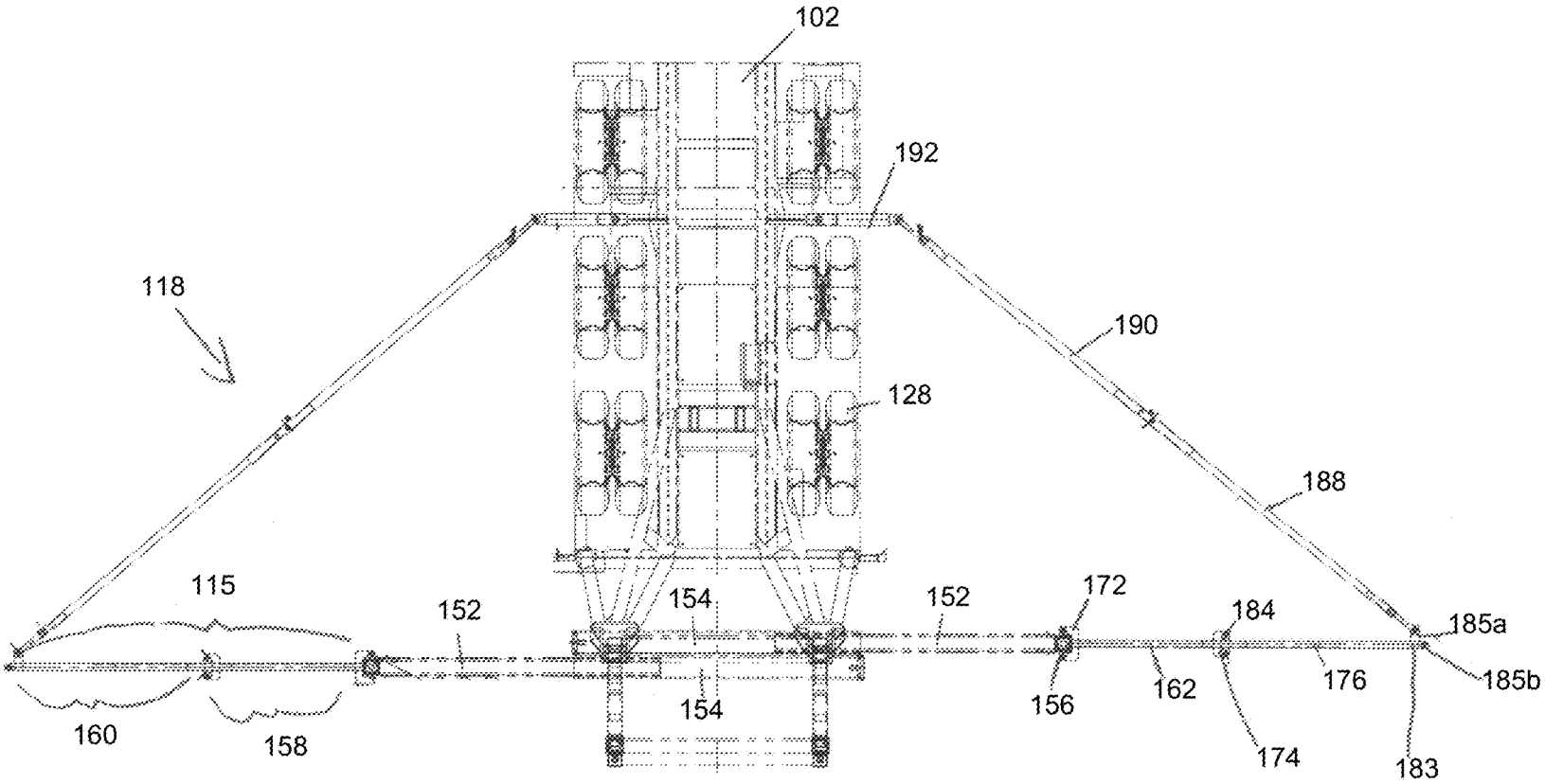
FIG. 13 is an overhead detail view of the rear outriggers and racking board supports of FIG. 12, together with a pair of bracing supports in an assembled position, according to one or more embodiments.

FIGS. 12 and 13 illustrate detailed views of the racking board supports 115 in an extended position. Each racking board support 115 may have an inner support bracket 158 extending from the rear outrigger 114, and an outer support bracket 160 extending from the inner support bracket.

The inner support bracket 158 may couple to the rear outrigger 114 in some embodiments. For example, the inner support bracket 158 may couple to the foot portion 156 or otherwise the outermost portion of the rear outrigger 114. In some embodiments, the inner support bracket may include a plurality of members. As shown in FIG. 12, the inner support bracket 158 may have an upper member 162, a lower member 164, a bracing member 166, an inner vertical member 168, and an outer vertical member 170. As shown in FIG. 13, the inner support bracket 158 may additionally have an inner lug connector 172 configured for coupling with the rear outrigger 114, and an outer lug connector 174 configured for coupling with the outer folding member 160.

Each of the members 162, 164, 166, 168, 170 may have a rounded or tubular shape in some embodiments. In other embodiments, the members may have any suitable cross sectional shape. In some embodiments, some of the members may have different cross sectional shapes than others. Each member may be composed of steel or other material(s). Each of the members may have any suitable width or diameter. In some embodiments, each of the members may have the same width or diameter, while in other embodiments, the some members may have different widths or diameters than other members. The members may generally be coupled together by welding or other suitable coupling means.

The inner vertical member 168 may be positioned vertically and may be adjacent to the rear outrigger 114. In some embodiments, the inner vertical member 168 may be positioned adjacent to the foot portion 156 of the rear outrigger 114, such that its length is positioned against the length of the foot portion. The inner vertical member 168 may have any suitable length. In some embodiments, the inner vertical member 168 may have a length shorter than that of the foot portion 156. The inner vertical member 168 may generally be positioned such that it is not touching the ground, pad, block, or other surface on which the foot portion 156 is positioned.

The upper member 162 may extend from the inner vertical member 168 and/or foot portion 156 at approximately a 90 degree angle. In some embodiments, the upper member 162 may extend from an upper surface of the inner vertical member 168. In some embodiments, the upper member 162 may be positioned such that an upper surface of the upper member may be flush with an upper surface of the foot portion 156 and/or an upper surface of the inner vertical member 168. The length of the upper member 162 may be generally aligned with the length of the rear outrigger 114. The upper member 162 may have any suitable length. In some embodiments, the upper member 162 may have a length of between 1 and 20 feet, for example. Particularly, in some embodiments, the upper member 162 may have a length of between 1 and 10 feet. More particularly, the upper member 162 may have a length of between 3 and 7 feet in some embodiments.

Additionally, the lower member 164 may also extend from the inner vertical member 168 and/or foot portion 156 at an angle. The lower member 164 may extend at an angle less than 90 degrees in some embodiments. In some embodiments, the lower member 164 may extend from a lower surface of the inner vertical member 168. In some embodiments, the lower member 164 may be positioned such that a lower surface of the lower member may be flush with a lower surface of the foot portion 156 and/or a lower surface of the inner vertical member 168. The lower member 164 may be positioned beneath the upper member 162 such that the lower and upper members may be generally aligned. The lower member 164 may have any suitable length. In some embodiments, the lower member 164 may have a length of between 1 and 20 feet, for example. Particularly, in some embodiments, the lower member 164 may have a length of between 1 and 10 feet. More particularly, the lower member 164 may have a length of between 3 and 7 feet in some embodiments.

The outer vertical member 170 may be positioned vertically between the upper member 162 and lower member 164. Where one end of each of the upper member 162 and lower member 164 may couple to the inner vertical member 168, an opposing end of the upper member and lower member may couple to the outer vertical member 170. The outer vertical member 170 may be parallel with the inner vertical member 168 in some embodiments. The outer vertical member 170 may have any suitable length, and in some embodiments may have a shorter length than the inner vertical member 168.

In some embodiments, the inner support bracket 158 may have a bracing member 166. The bracing member 166 may be positioned at an angle between the inner vertical member 168 and the outer vertical member 170, and additionally between the upper member 162 and the lower member 164. The bracing member 166 may extend from an innermost portion of the lower member 164 to an outermost portion of the upper member 162. The bracing member 166 may have any suitable length. In some embodiments, the bracing member 166 may have a length of between 1 and 20 feet, for example. Particularly, in some embodiments, the bracing member 166 may have a length of between 1 and 10 feet. More particularly, the bracing member 166 may have a length of between 3 and 7 feet in some embodiments.

The inner support bracket 158 may have one or more inner lug connectors 172. The inner lug connector 172 may comprise an angled bracket having three sides and two pin, screw, or bolt holes, in some embodiments. The inner lug connector 172 may have three sides configured to be positioned around the foot portion 156 to meet with the lugs 157 extending from the foot portion, as shown in FIG. 13. For example, the inner lug connector 172 may have a first side and second side parallel to the first side, each of the first and second sides having a pin, screw, or bolt hole, and a third side perpendicular to the first and second sides and connecting the first and second sides. The inner lug connector 172 may couple to the upper member 162, lower member 164, and/or inner vertical member 168. The inner lug connector 172 may further couple the inner support bracket 158 to the rear outrigger 114. For example, in some embodiments, the inner lug connector 172 may couple to the foot portion 156 via two lugs 157, such that a bolt, pin, or screw may be positioned in the holes of the inner lug connector and lugs. In some embodiments, the inner support bracket 158 may have multiple inner lug connectors 172. For example, as shown in FIG. 12, two inner lug connectors 172 may couple the inner support bracket 158 to the foot portion 156. In other embodiments, any suitable number of inner lug connectors 172 may be used. Further, in other embodiments, the inner support bracket 158 may be coupled to the foot portion 156 using other coupling mechanisms.

Additionally, the inner support bracket 158 may have one or more outer lug connectors 174. The outer lug connector 174 may comprise an angled bracket having three sides and two pin, screw, or bolt holes, in some embodiments. The outer lug connector 174 may have three sides configured to be positioned around the outer support bracket 158 to meet corresponding lugs, as shown in FIG. 13. For example, the outer lug connector 174 may have a first side and second side parallel to the first side, each of the first and second sides having a pin, screw, or bolt hole, and a third side perpendicular to the first and second sides and connecting the first and second sides. The outer lug connector 174 may couple to the upper member 162, lower member 164, and/or outer vertical member 170. The outer lug connector 174 may further couple the inner support bracket 158 to the outer support bracket 160. In some embodiments, the inner support bracket 158 may have multiple outer lug connectors 174. For example, as shown in FIG. 12, two outer lug connectors 174 may couple the inner support bracket 158 to the outer support bracket 160. In other embodiments, any suitable number of outer lug connectors 174 may be used. Further, in other embodiments, the inner support bracket 158 may be coupled to the outer support bracket 160 using other coupling mechanisms.

With continued reference to FIGS. 12 and 13, the outer support bracket 160 may couple to the inner support bracket 158. For example, the outer support bracket 160 may couple to the outermost portion of the inner support bracket 158. In some embodiments, the outer support bracket 160 may include a plurality of members. As shown in FIG. 12, the outer support bracket 160 may have an upper member 176, a lower member 178, a bracing member 180, an inner vertical member 182, and an outer vertical member 183. As shown in FIG. 13, the outer support bracket 160 may additionally have one or more lugs 182 for coupling with the inner support bracket 158 and/or other equipment, as discussed below.

Each of the members 176, 178, 180, 182, 183 may have a rounded or tubular shape in some embodiments. In other embodiments, the members may have any suitable cross sectional shape. In some embodiments, some of the members may have different cross sectional shapes than others. Each member may be composed of steel or other material(s). Each of the members may have any suitable width or diameter. In some embodiments, each of the members may have the same width or diameter, while in other embodiments, the some members may have different widths or diameters than other members. The members may generally be coupled together by welding or other suitable coupling means.

The inner vertical member 182 may be positioned vertically and may be adjacent to the inner support bracket 158. In some embodiments, the inner vertical member 182 may be positioned adjacent to the outer vertical member 170 of the inner support bracket 158, such that the lengths of the two vertical members 182, 170 are positioned against one another. The inner vertical member 182 may have any suitable length. In some embodiments, the length of the inner vertical member 182 may be equal to that of the outer vertical member 170.

The upper member 176 may extend from the inner vertical member 182 at approximately a 90 degree angle. In some embodiments, the upper member 176 may extend from an upper surface of the inner vertical member 182. In some embodiments, the upper member 176 may be positioned such that an upper surface of the upper member may be flush with an upper surface of the inner vertical member 182 and/or an upper surface of the inner support bracket 158. The length of the upper member 176 may be generally aligned with the length of the rear outrigger 114 and inner support bracket 158. The upper member 176 may have any suitable length. In some embodiments, the upper member 176 may have a length of between 1 and 20 feet. Particularly, the lower member may have a length of between 1 and 10 feet in some embodiments. More particularly, the upper member 176 may have a length of between 3 and 7 feet in some embodiments.

Additionally, the lower member 178 may also extend from the inner vertical member 182 at an angle. The lower member 178 may extend at an angle less than 90 degrees in some embodiments. In some embodiments, the lower member 176 may be positioned such that a lower surface of the lower member may be flush with a lower surface of the inner vertical member 182 and/or a lower surface of the inner support bracket 158. The lower member 178 may be positioned beneath the upper member 176 such that the lower and upper members may be generally aligned. The lower member 178 may have any suitable length. In some embodiments, the lower member 178 may have a length of between 1 and 20 feet, for example. Particularly, in some embodiments, the lower member 178 may have a length of between 1 and 10 feet. More particularly, the lower member 178 may have a length of between 3 and 7 feet in some embodiments.

In some embodiments, the outer support bracket 160 may have a bracing member 180. The bracing member 180 may be positioned at an angle between the inner vertical member 182 and the lower member 178 and/or at an angle between the upper member 176 and the lower member 178. The bracing member 180 may extend from an innermost portion of the upper member 176 and extend toward the lower member 178. The bracing member 180 may have any suitable length. In some embodiments, the bracing member 180 may have a length of between 1 and 20 feet, for example. Particularly, in some embodiments, the bracing member 180 may have a length of between 1 and 10 feet. More particularly, the bracing member 180 may have a length of between 3 and 7 feet in some embodiments.

The outer vertical member 183 may be positioned vertically between the upper member 176 and lower member 178. Where one end of each of the upper member 176 and lower member 178 may couple to the inner vertical member 182, an opposing end of the upper member and lower member may couple to the outer vertical member 183. The outer vertical member 183 may be parallel with the inner vertical member 182 in some embodiments. The outer vertical member 183 may have any suitable length, and in some embodiments may have a shorter length than the inner vertical member 182.

The outer support bracket 160 may have one or more lugs 184, 185 for coupling the outer support bracket to one or more other elements. For example, in some embodiments, the outer support bracket 160 may have one or more lugs 184 or sets of lugs extending from the inner vertical member 182, upper member 176, and/or lower member 178, and configured for coupling the outer support bracket to the inner support bracket 158. For example, as shown in FIG. 13, two lugs 184 may be positioned on the outer support bracket 160 so as to couple with the outer lug connector 174, such that a pin, bolt, or screw, for example, may be passed through the lugs and lug connector. In some embodiments, the outer support bracket 160 may have, for example, two or four lugs 184 configured to couple with the inner support bracket 158. In other embodiments, the inner support bracket 158 and outer support bracket 160 may be coupled using other coupling mechanisms. Additionally, in some embodiments, the outer support bracket 160 may have one or more lugs 185 arranged on the outer vertical member 183 and configured for coupling to other equipment. For example, a lug 185*a* may be arranged on the outer vertical member 183 and configured for coupling to a bracing member 118. Additionally or alternatively, a lug 185*b* may be positioned on the outer vertical member 183 and configured for coupling to an internal guyline 116.

In the assembled position, the distance between the outermost points of the racking board supports 115, that is the distance between each point of the two racking board supports extending furthest from the base 102, may be between 10 and 100 feet in some embodiments. Particularly, the distance between the outermost points may be between 20 and 70 feet in some embodiments. More particularly, the distance between the outermost points may be between 30 and 50 feet in some embodiments. In other embodiments, the distance between the outermost points when the racking board supports 115 are in an assembled position may be any suitable distance.

With continued reference to FIG. 13, in some embodiments, one or more bracing supports 118 may be positioned between the racking board supports 115 and the base 102 of the rig 100. The one or more bracing supports 118 may be configured to help stabilize the racking board supports 115. In some embodiments, the bracing supports 118 may be or include a telescoping brace having an internal telescoping member 188 that extends from a bracing member 190. In some embodiments, the bracing supports 118 may couple to the base 102 by way a of a base support member 192.

The telescoping member 188 may be a steel or other material member. The telescoping member 188 may have a rounded or tubular shape in some embodiments. In other embodiments, the telescoping member 188 may have any suitable cross sectional shape. The telescoping member 188 may have any suitable length. In some embodiments, the telescoping member 188 may have a length of between 1 and 30 feet. Particularly, the telescoping member 188 may have a length of between 5 and 20 feet in some embodiments. More particularly, the telescoping member 188 may have a length of between 8 and 12 feet in some embodiments. At a first end of the telescoping member 188, the member may couple to the outer support bracket 160 at an angle, which may be less than 90 degrees in some embodiments. For example, in some embodiments, the telescoping member 188 may couple to the outer support bracket 160 at approximately a 45 degree angle. The telescoping member 188 may couple to the outer support bracket 160 via a lug 185*a*, as described above, and a pin, bolt, screw, or other coupling device. An opposing end of the telescoping member 188 may extend from the bracing member 190.

The bracing member 190 may be a steel or other material member. The bracing member 190 may have a round or tubular shape in some embodiments. In other embodiments, the bracing member 190 may have any suitable cross sectional shape. The bracing member 190 may be hollow or partially hollow in some embodiments, such that it may receive the telescoping member 188. The telescoping member 188 may be configured to nest within the bracing member 190. The bracing member 190 may have any suitable length. In some embodiments, the bracing member 190 may have a length of between 1 and 30 feet. Particularly, the bracing member 190 may have a length of between 5 and 20 feet in some embodiments. More particularly, the bracing member 190 may have a length of between 8 and 12 feet in some embodiments. At a first end, the bracing member 190 may couple to the telescoping member 188. In some embodiments, a stopping or locking device may be used to adjust the length that the telescoping member 188 extends from the bracing member 190. For example, a pin inserted through aligned holes in each of the telescoping member 188 and bracing member 190 may be used to stop and or adjust the length of the telescoping member 188. In other embodiments, other stopping and/or locking mechanisms may be used. At an opposing end of the bracing member 190, the member may couple to the base 102 of the rig 100. In some embodiments, the bracing member 190 may couple to a base support member 192 via a lug and pin connection or other suitable connection.

The base support member 192 may be a steel or other material member extending across at least a portion of the width of the base 102. The base support member 192 may be coupled to the base 102 and may provide an attachment point for the bracing support 118. In some embodiments, the rig 100 may have a base support member 192 on opposing sides of the rig 100, as shown in FIG. 13, for example. In this way, the base support member 192 may extend less than the full width of the base 102. In other embodiments, the rig 100 may have a base support member 192 that extends to both sides of the rig so as to provide a coupling point for each bracing support 118. In some embodiments, the base support member 192 may extend beyond the width of the base 102, such that the bracing support 118 couples to the base support member at a distance from the base. The base support member 192 may have one or more lugs or other attachment mechanisms for coupling to the bracing support 118.

When extended and coupled to the base support member 192 and outer support bracket 160, the bracing support 118 may have a length of between 1 and 40 feet in some embodiments. Particularly, the bracing support 118 may have a length of between 10 and 30 feet in some embodiments. More particularly, the bracing support 118 may have a length of between 15 and 25 feet in some embodiments. It may be appreciated that the bracing supports 118 may add stability to the front outriggers 112 and/or rear outriggers 114 in some embodiments. Particularly, the bracing supports 118 may help stabilize positioning of the foot portions on the ground surface, pad surface, block, or pedestal on which they may be positioned.

Figure 14:
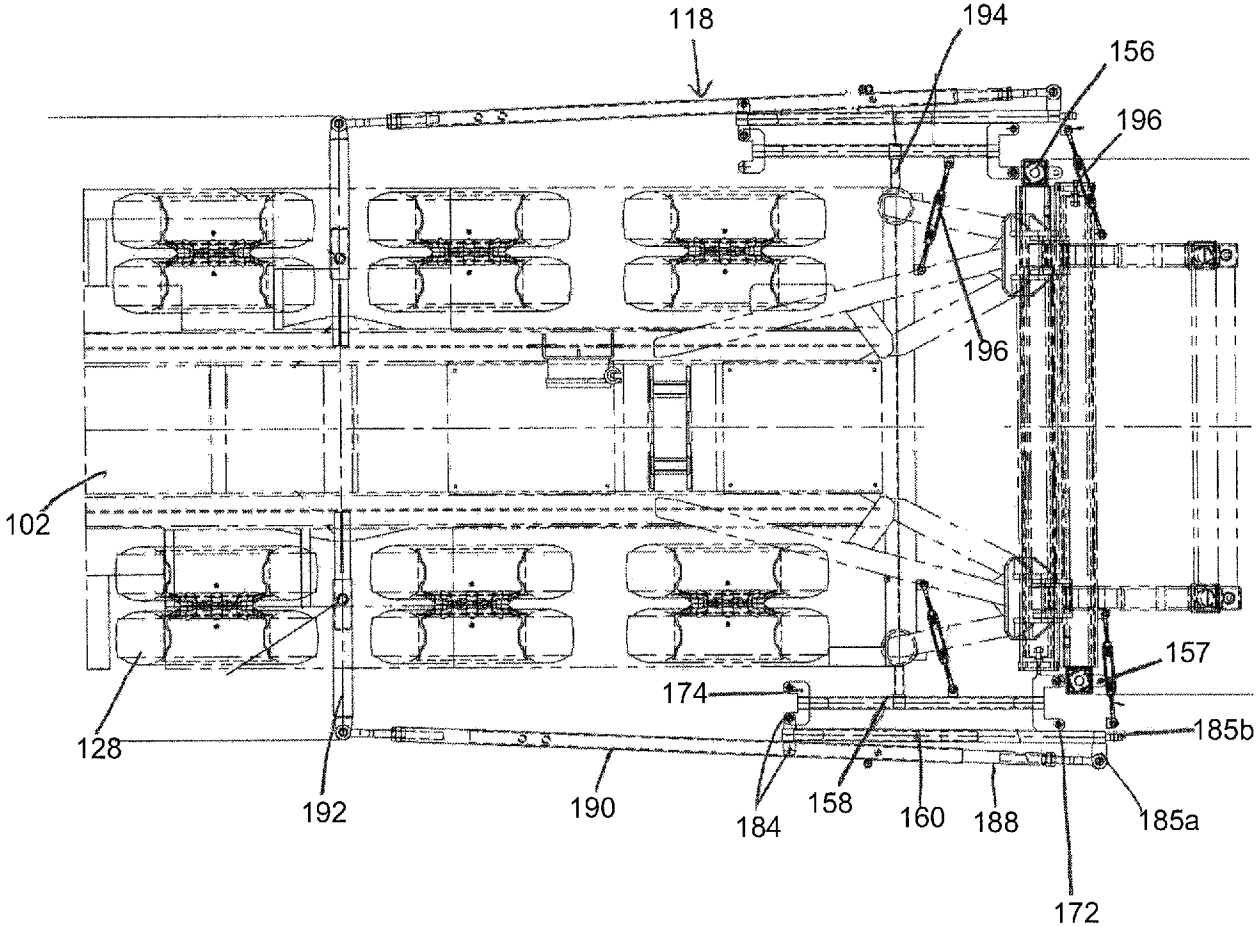
FIG. 14 is an overhead detail view of the rear outriggers, racking board supports, and bracing supports of FIG. 13 in a roading position, according to one or more embodiments.
Figure 15:
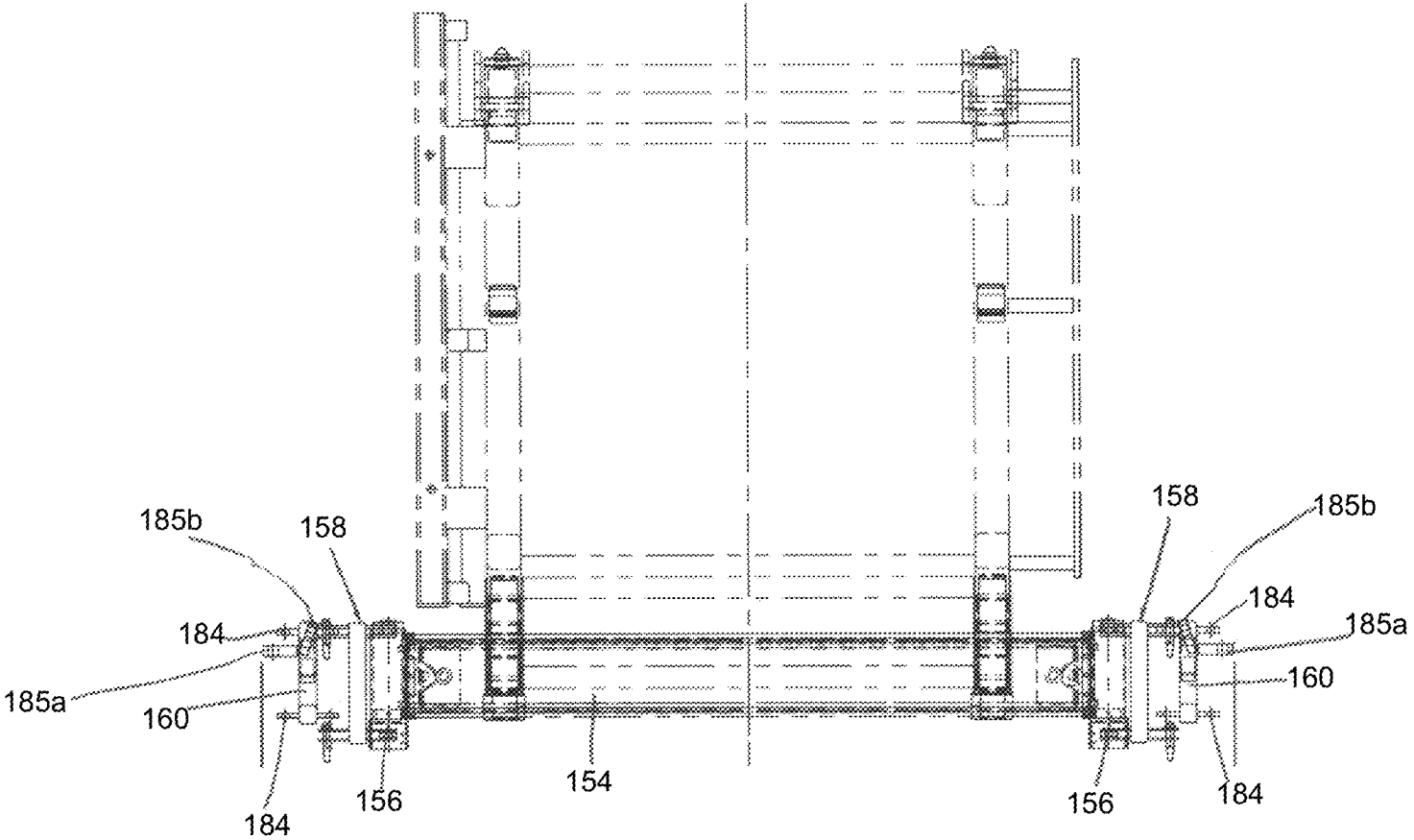
FIG. 15 is an end detail view of the rear outriggers, racking board supports, and bracing supports of FIG. 13 in a roading position, according to one or more embodiments.

In some embodiments, the racking board supports 115 and/or bracing supports 118 may retract, fold, pivot, or otherwise be positioned in a roading position. Turning now to FIGS. 14 and 15, the racking board supports 115 and bracing supports 118 are shown in a roading position. As shown, each of the bracing member 190, telescoping member 188, outer support bracket 160, and inner support bracket 158 may pivot about its respective pinned or other connections, into a folded roading position.

In the roading position, the inner support bracket 158 may be pivoted about its connection to the rear outrigger 114. For example, where the inner support bracket 158 has an inner lug connector 172, a pin may be removed from one side of the lug connector such that one side of the lug connector remains coupled to the foot portion 156 while an opposing side of the lug connector is not. In this way, the inner support bracket 158 may pivot inward toward base 102 of the rig 100 and toward an engine end 122 of the carrier frame 120 of the rig. In some embodiments, the axis about which the inner support bracket 158 rotates may be a vertical axis. In the roading position, the length of the inner support bracket 158 may be positioned adjacent to the base 102. In some embodiments, a spacer 194 or other device may be used to help prevent the inner support bracket 158 from pivoting too far abut its connection to the foot portion 156 and/or to hold the inner support bracket in the roading position. One or more turnbuckles 196 or other devices may additionally or alternatively be used to secure the inner support bracket 158 in the roading position.

With continued reference to FIG. 13, the outer support bracket 160 may pivot about its pinned connection to the inner support bracket 158 in the roading position. For example, where the inner support bracket 158 has an outer lug connector 174, a pin may be removed from one side of the lug connector such that one side of the lug connector remains coupled to the outer support bracket 160 while an opposing side of the lug connector is not. In this way, the outer support bracket 160 may pivot outward toward the base 102 of the rig 100 and toward a mast end 124 of the carrier frame 120. In this way, the outer support bracket 160 may pivot in an opposite direction than the inner support bracket 158. In some embodiments, the axis about which the outer support bracket 160 rotates may be a vertical axis. In the roading position, the length of the outer support bracket 160 may be positioned adjacent to the length of the inner support bracket 158. In some embodiments, one or more turnbuckles 196 or other devices may be used to secure the outer support bracket 160 in the roading position.

As the inner support bracket 158 and outer support bracket 160 pivot forward and backward, respectively, toward the base 102, the bracing supports 118 may remain coupled to the outer support bracket and base support member 192. The bracing supports 118 may thus pivot about their pinned connections to each of the outer support bracket 160 and the base support member 192. In this way, each bracing support 118 may be positioned adjacent to the outer support bracket 160, and the angle from which the bracing support extends from the base support member 192 may be reduced. In some embodiments, the telescoping member 188 may be partially or fully retracted within the bracing member 190.

Turning now to FIG. 15, the oil rig 100 is shown from an end view in the roading position. In the roading position, the distance between the outermost points of the racking board supports 115, that is the points extending furthest out from each side of the base 102, may be between 5 and 40 feet in some embodiments. Particularly, the distance between the outermost points may be between 5 and 20 feet in some embodiments. More particularly, the distance between the outermost points may be between 7 and 15 feet in some embodiments. In this way, it may be appreciated that the oil rig 100 in a roading position may have a suitable width for driving or hauling on highways or other roads, for example. In other embodiments, the distance between the outermost points when the racking board supports 115 are in a roading position may be any suitable distance.

Figure 16:
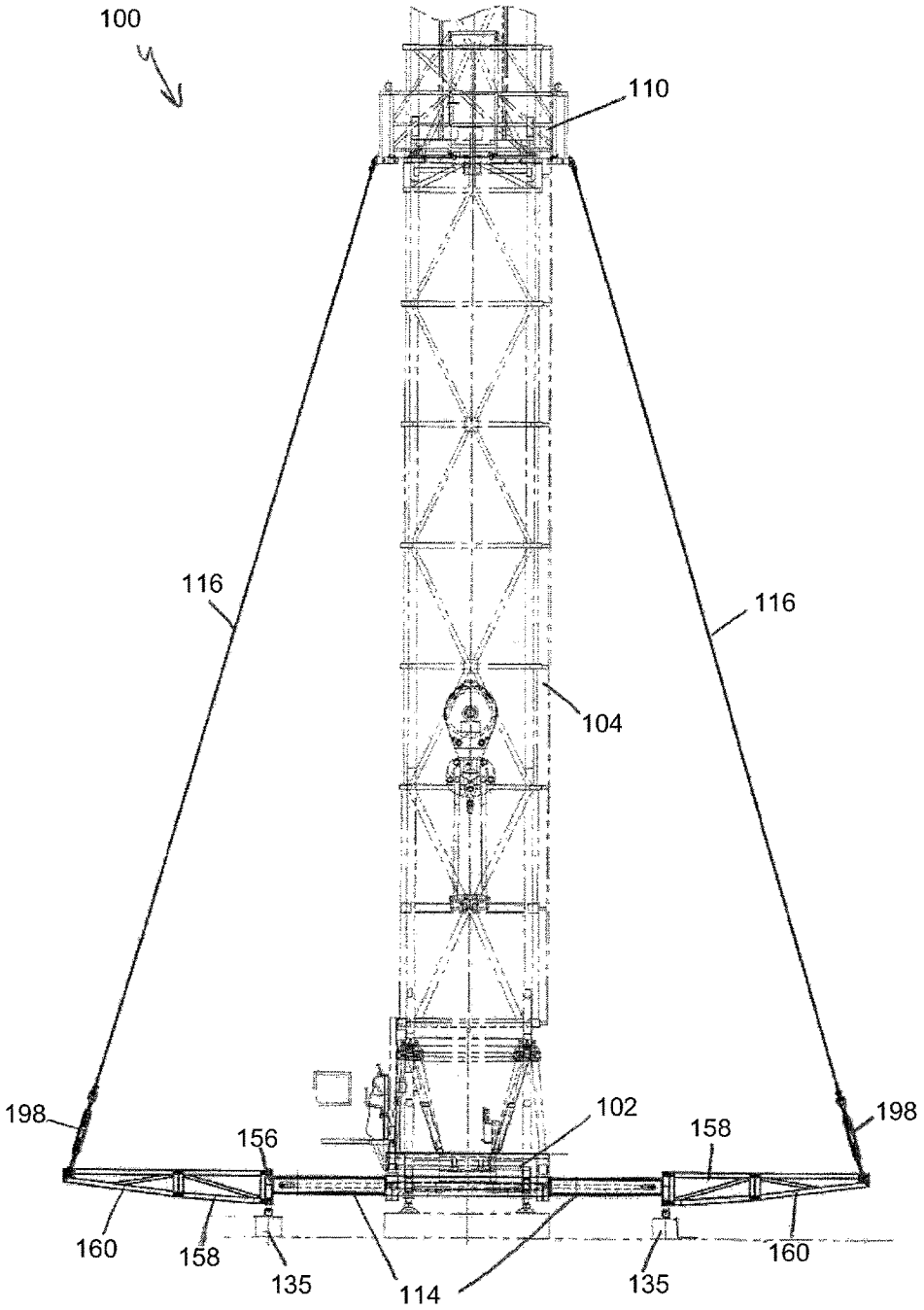
FIG. 16 is an end view of the servicing rig of FIG. 1 in an assembled position, according to one or more embodiments.

Turning now to FIG. 16, the stabilization system may include one or more internal guylines 116. Each internal guyline 116 may be a cable, cord, chain, rope, or other device. The guylines 116 may couple at a first end to the mast 102. For example, in some embodiments, the internal guylines 116 may couple at a first end to a racking board 110 via lugs or other coupling mechanisms. In other embodiments, the internal guylines 116 may couple to a different point on the mast 104. In some embodiments, the guylines 116 may couple at a second end to the racking board supports 115. For example, each guyline 116 may couple to a lug 185*b* on one of the outer support brackets 160. In other embodiments, the guylines 116 may couple to a different location on the rig 100 or to the ground, pad, or other surface. In some embodiments, the rig 100 may have two internal guylines 116, such that one guyline extends between the racking board 110 and each outer support bracket 160. The guylines 116 may each couple to opposing sides of the racking board 110, and extend down to each of the two outer support brackets 160. In other embodiments, the rig 100 may have any suitable number of internal guylines 116. For example, the rig 100 may have four or six internal guylines 116 in some embodiment. Each internal guyline 116 may have any suitable length. In some embodiments, the internal guylines 116 may each have a length of between 20 and 100 feet in some embodiments. Particularly, each internal guyline 116 may have a length of between 30 and 80 feet in some embodiments. More particularly, each internal guyline 116 may have a length of between 50 and 60 feet in some embodiments.

In some embodiments, one or more turnbuckles 198 or other attachment mechanisms may be used to couple the guylines 116 to the outer support bracket 160 and/or racking board 110. Generally, in a roading position, the internal guylines 116 may be disconnected from the outer support brackets 160 and/or racking board 110.

In use, the front outriggers 112, rear outriggers 114, racking board supports 115, and/or internal guylines 116 may help to stabilize the rig 100 against wind loading, jarring, or other forces. The rig 100 may be driven or otherwise transported to a well location. In some embodiments, the rig 100 may be transported in a roading position. The rig 100 may be positioned over a well location and erected from a roading position to an assembled position. In some embodiments, converting the rig 100 to an assembled position may include raising the mast 102 to an operating height. Assembling the rig 100 may additionally include pivoting the front outriggers 112 from the roading position into the assembled position. Once pivoted into an assembled position, the front outriggers 112 may be pinned or otherwise locked into position. The rear outriggers 114 may be telescoped outward. Foot portions 132, 156 for each of the front and rear outriggers may be positioned on the ground surface, pad surface, pedestal surface, block surface, or other surface. For example, the height of the foot portions may be adjusted using jacking screws. Assembly of the rig 100 may further include unfolding the racking board supports 115. Once unfolded, each of the inner support brackets 158 and outer support brackets 160 may be pinned or otherwise locked into the assembled position. Assembly of the rig 100 may further include coupling the internal guylines 116 to the racking board 110 and racking board supports 115.

Figure 17:
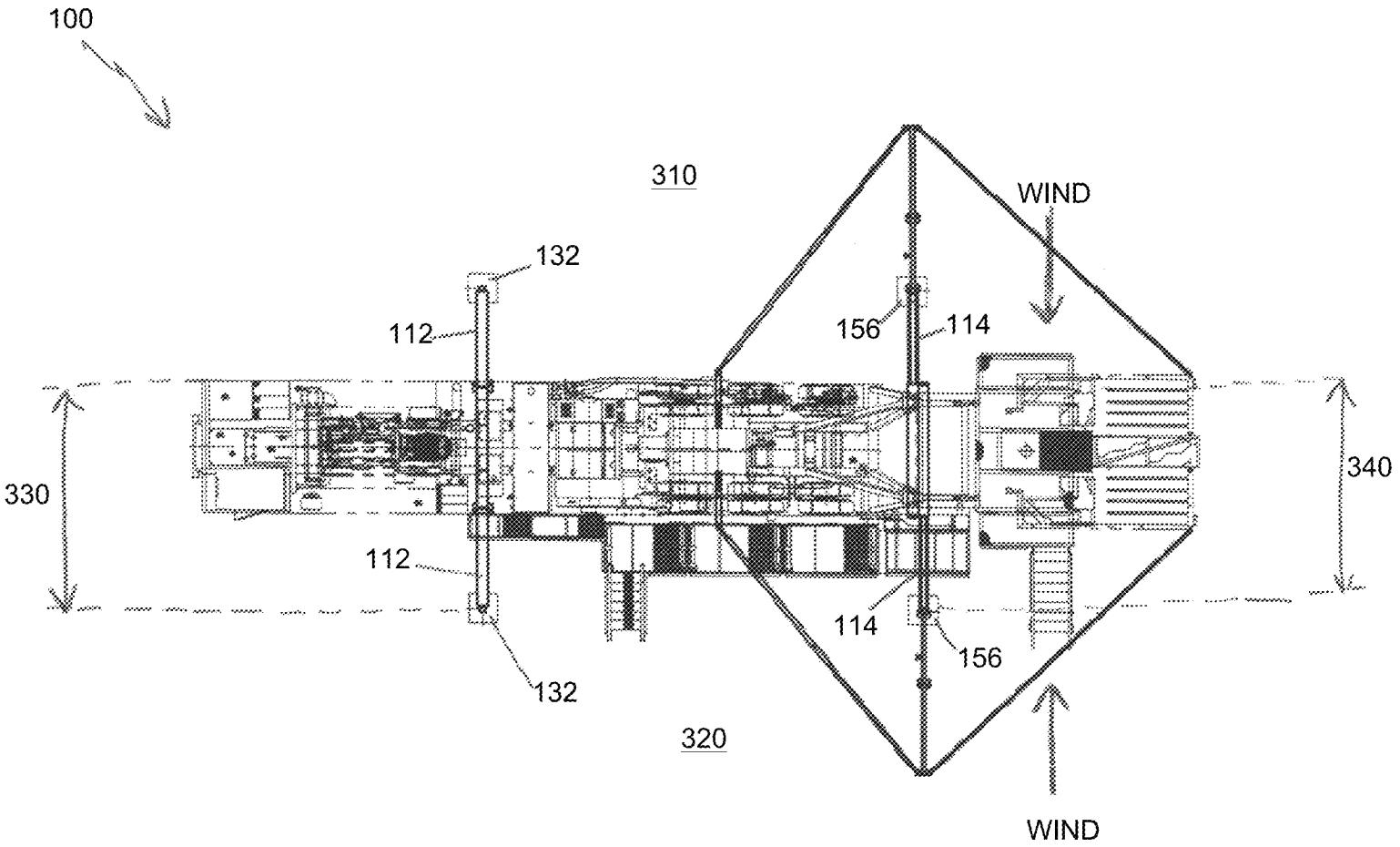
FIG. 17 is an overhead view of the of the servicing rig of FIG. 1, according to one or more embodiments.

The front outriggers 112, rear outriggers 114, racking board supports 115, and/or internal guylines 116 may help prevent the oil rig from tipping due to lateral wind loading or other forces. That is, wind loading on the rig 100, and particularly along the length of the erected mast 102, may cause the rig to have a tendency to tip or tilt. It may be appreciated that the length of each of the front 112 and rear outriggers 114 may define a moment arm for resisting rotation of the rig 100 due to wind or other lateral loading. Turning to FIG. 17, for example, where wind loading acts on a first longitudinal side 310 of the rig 100, the rig may tend to pivot about foot portions 132, 156 on an opposing, second longitudinal side 320. In this way, the front 112 and rear outriggers 114 may extend the pivot point of the rig, or the point about which a moment force of the wind loading acts, from the base 102 of the rig 100 to the location of the foot portions 132, 156. Moreover, as wind loading acts on the first longitudinal side 310, a moment arm 330 for a front outrigger 112 for the resulting moment may be defined as a horizontal distance between the first longitudinal side of the base 102 and the point at which the foot portion 132 touches the ground, pad, pedestal, block, or other surface. Similarly, a moment arm 340 for a rear outrigger 114 for the resulting moment caused by wind loading on the first side 310 may be defined as a horizontal distance between the first longitudinal side of the base 102 and the point at which the foot portion 156 touches the ground, pad, pedestal, block, or other surface. In this way, it may be appreciated that the front outriggers 112 and rear outriggers 114 may extend the moment arm for tipping or tilting the oil rig 100 due to wind loading. Additionally, the racking board supports 115 may operably counteract at least some torsion forces applied to the racking board 110 and one or more racking board hinges due to wind loading, for example when the racking board is loaded with pipe or winterization.

Further, in some embodiments, front outrigger foot portions 132 and/or rear outrigger foot portion 156 may be configured for providing an alert. For example, each foot portion 132, 156 may be positioned above the pedestal 135 or other surface such that it lightly touches the pedestal or other surface. That is, the foot portion 132, 156 may be positioned on the pedestal 135 or other surface in such a way that little or no dead load from the rig 100 is transferred to the pedestal or other surface. Or in some embodiments, the foot portions 132, 156 may be positioned such that there is a relatively small clearance, such as for example a half inch clearance, between the foot portions and pedestal 135 or other surface. As described above, each foot portion 132, 156 may have a jackscrew 144 or other mechanism for adjusting the height of the foot portion.

As wind loading acts on the rig 100, such as on a first longitudinal side 310 of the rig for example, the foot portions 132, 156 on the second longitudinal side 320 may become loaded, as the foot portions may be moment centers. In some embodiments, the first longitudinal side 310 may be an off-operator's side of the rig 100 for example, and the second longitudinal side 320 may be an operator's side of the rig. As a load is applied to the foot portions 132, 156, the jackscrews 144, 244 may move upward and push against the plurality of washers 142, 242. The plurality of washers 142, 242 may in turn compress or flatten, particularly where the washers are Belleville or other rounded or curved washers, as shown in FIGS. 8A and 8B. In some embodiments, the washers 142, 242 may produce a reaction force on the jackscrew 144 as the loading applies to flatten or compress the washers. It may be appreciated that this reaction force may have the effect of requiring a stronger wind load in order for the jackscrew 144, 244 to be moved or pushed upward as a result of the wind loading. In some embodiments, a pressure valve may be positioned on or near one or more foot portions 132, 156. For example, the pressure valve may couple to the jackscrew 144, 244 via a cam roller or other device arranged on or in communication with the capscrew 146, 246. As the jackscrew 144, 244 moves upward as a result of the wind loading, the jackscrew may act on the capscrew 146, 246 positioned through openings in the jackscrew and outer sheath 140, 240, in turn causing the cam roller to open the air valve. For example, the jackscrew 144, 244 may be configured such that the capscrew 146, 246 and cam roller only reach the air valve when a particular pre-determined quantity of force is applied to the jackscrew. The air valve may in turn send air pressure to an air horn or other alerting device located on the rig 100, thus notifying workers of a potential rig overturn, settling condition, or other loading situation. In some embodiments, the foot portions 132, 156 may be configured to be displaced enough to trigger the air valves after a particular load is applied to the foot portions. For example, in some embodiments, the front outrigger foot portions 132 may be configured to trip the air valve when a load of at least 10,000 pounds is applied to the foot portions. In some embodiments, the rear outrigger foot portions 156 may be configured to trip the air valve when a load of at least 50,000 pounds is applied to the foot portions. In other embodiments, the foot portions 132, 156 may be configured to trip the air valve at other applied forces. It may be appreciated that in other embodiments, other alerting mechanisms may be used to signify that a particular load is acting on the rig 100 and/or that overturn or other conditions may be possible. Additionally or alternatively, loading on the foot portions 132, 156 may generally be monitored.

It may be appreciated that the stabilization system of the oil rig 100 of the present disclosure may be configured to stabilize the rig, under at least some wind conditions, without the use of external guylines or anchors. That is, the front outriggers 112, rear outriggers 114, racking board supports 115, and/or internal guylines 116 may provide stability against wind or other loading without the need to additionally anchor the rig 100 to the ground surface, pad surface, or other surface. In some embodiments, the rig 100 may be stabilized in this way, without the need for external guylines or anchors, against wind speeds up to 40 or 45 miles per hour. In some embodiments, the stabilization system may provide overturn stability for the rig 100 with approximately a 1.25 or higher safety factor for overturn. In other embodiments, the rig 100 may be stabilized in this way against higher or lower wind speeds. In this way, the rig 100 may be generally self-contained, without the need for external anchors in the ground or other surface. Moreover, it may be appreciated that the rig 100 may have a smaller footprint than a rig having external guylines. That is, a rig 100 of the present disclosure may be stabilized against wind or other forces and yet require less ground clearance. However, it may further be appreciated that a rig having a stabilization system of the present disclosure may be used in conjunction with external guylines and/or anchors in some embodiments. For example, the addition of external guylines and anchors may provide stability against higher wind loads in some embodiments.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an ingredient or element may still actually contain such item as long as there is generally no measurable effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

We claim:

1. A well rig, comprising:
a mast;
a base supporting the mast; and
a stabilization system configured to secure the rig against wind loading, the stabilization system comprising:
a pair of front outriggers;
a pair of rear outriggers extending in a lateral direction from the base from a rig end to a foot end;
a pair of racking board supports coupled to the rear outriggers at the foot end and continuing in the lateral direction from the rear outriggers to a free unsupported end; and
a pair of internal guylines coupling the mast to the rear outriggers and extending from the free unsupported end of respective racking board supports to the mast.

2. The well rig of claim 1, wherein the guylines couple to the mast at a racking board.

3. The well rig of claim 1, wherein the mast comprises a rod board.

4. The well rig of claim 1, wherein the stabilization system further comprises a pair of bracing supports extending between the base and the racking board supports.

5. The well rig of claim 4, wherein the bracing supports are pivotably coupled to the base and to the racking board supports.

6. The well rig of claim 1, wherein the front outriggers are pivotably coupled to the base.

7. The well rig of claim 1, wherein the rear outriggers are configured to telescope outward from the base.

8. The well rig of claim 1, wherein the racking board supports are pivotably coupled to the rear outriggers.

9. The well rig of claim 1, wherein the well rig is a mobile rig.

10. The well rig of claim 9, wherein the stabilization system is configured to be arranged in a roading position.

11. The well rig of claim 1, wherein one or more outriggers comprises a foot portion, comprising:
a jackscrew; and
a plurality of washers arranged proximate to the jackscrew;
wherein the foot portion is communicably coupled to a pressure valve configured to activate in response to a force applied to the foot portion.

12. The well rig of claim 11, wherein the pressure valve is communicably coupled to an alarm configured to sound in response to activation of the pressure valve.

13. The well rig of claim 11, wherein the washers are Belleville washers.

14. A stabilization system for a well rig having a base supporting a mast, the stabilization system comprising:
a pair of front outriggers extending from the base;
a pair of rear outriggers extending in a lateral direction from the base from a rig end to a foot end;
a pair of racking board supports coupled to the rear outriggers at the foot end and continuing in the lateral direction from the rear outriggers to a free unsupported end; and
a pair of internal guylines coupling the mast to the rear outriggers and extending from the free unsupported end of respective racking board supports to the mast.

15. The stabilization system of claim 14, further comprising a pair of bracing supports extending between the base and the racking board supports.

16. The stabilization system of claim 14, wherein one or more outriggers comprises a foot portion, comprising:
a jackscrew; and
a plurality of washers arranged proximate to the jackscrew;
wherein the foot portion is communicably coupled to a pressure valve configured to activate in response to a force applied to the foot portion.

17. The stabilization system of claim 16, wherein the pressure valve is communicably coupled to an alarm configured to sound in response to activation of the pressure valve.

18. A method for stabilizing a well rig, the method comprising:
extending a pair of front outriggers from a base portion of the well rig and setting a foot;
extending a pair of rear outriggers in a lateral direction from the base portion of the well rig and setting a foot at a foot end thereof;
extending a pair of racking board supports, each racking board support extending further in the lateral direction from the foot end of a respective rear outrigger to a free unsupported end; and
coupling a pair of internal guylines between a mast of the well rig and the free unsupported end of the racking board supports.

* * * * *